US011721310B2

(12) United States Patent
Cardozo

(10) Patent No.: US 11,721,310 B2
(45) Date of Patent: Aug. 8, 2023

(54) SELF-LOCKING STRING TUNER AND METHOD THEREFOR

(71) Applicant: William B. Cardozo, Ketchum, ID (US)

(72) Inventor: William B. Cardozo, Ketchum, ID (US)

( * ) Notice: Subject to any disclaimer, the term of this patent is extended or adjusted under 35 U.S.C. 154(b) by 0 days.

(21) Appl. No.: 17/197,119

(22) Filed: Mar. 10, 2021

(65) Prior Publication Data

US 2022/0293070 A1 Sep. 15, 2022

(51) Int. Cl.
*G10D 3/147* (2020.01)

(52) U.S. Cl.
CPC ..... *G10D 3/147* (2020.02)

(58) Field of Classification Search
CPC ..... G10D 3/147; G10D 3/00
See application file for complete search history.

(56) References Cited

U.S. PATENT DOCUMENTS

| | | | | |
|---|---|---|---|---|
| 2,029,134 | A | 1/1936 | Stanley et al. | |
| 4,014,239 | A | 3/1977 | Spercel | |
| D256,471 | S | 8/1980 | Spercel | |
| 4,353,280 | A | 10/1982 | Spercel | |
| 4,625,614 | A | 12/1986 | Spercel | |
| 4,827,825 | A | 5/1989 | Goto et al. | |
| D311,414 | S | 10/1990 | Smith et al. | |
| 5,097,736 | A * | 3/1992 | Turner | G10D 3/14 24/71.1 |
| 5,381,715 | A | 1/1995 | Spercel | |
| 5,589,653 | A | 12/1996 | Rose | |
| 6,078,001 | A | 6/2000 | Kang | |
| 6,608,248 | B1 | 8/2003 | Sperzel | |
| 7,659,465 | B1 | 2/2010 | McEwen | |
| 8,093,475 | B1 | 1/2012 | Sperzel | |
| 8,859,868 | B2 | 10/2014 | Dunwoodie | |
| 9,330,636 | B1 | 5/2016 | Chang | |
| 9,489,929 | B1 | 11/2016 | Armstrong | |
| 9,564,110 | B2 | 2/2017 | Steinberger | |
| 9,799,310 | B2 | 10/2017 | Damaschke et al. | |
| 2006/0016317 | A1 | 1/2006 | Wilkinson | |
| 2017/0365239 | A1 | 12/2017 | Peterson | |

FOREIGN PATENT DOCUMENTS

| | | | | |
|---|---|---|---|---|
| JP | H05119768 A | | 5/1993 | |
| JP | WO2001052233 | * | 7/2001 | G10D 3/14 |
| WO | 2020006623 A1 | | 1/2020 | |

* cited by examiner

*Primary Examiner* — Kimberly R Lockett
(74) *Attorney, Agent, or Firm* — Milord A. Keshishian

(57) ABSTRACT

A self-locking tuner is used to tune the strings of a musical instrument. The self-locking tuner is disposed in a headstock of the stringed musical instrument. The self-locking tuner has an inner string post, outer string post disposed over the inner string post, locking pin extending above the inner string post and through the outer string post to the opening, and insert disposed around the outer string post. Alternatively, a cast housing is disposed around the outer string post with a stop to unlock a string. The string extends through an opening in the outer string post. The insert or cast housing has a stop to unlock the string. The outer string post has a rotational stop which contacts the stop to unlock the string. The insert is disposed in a headstock with the tab disposed in a slot formed in a surface of the headstock.

14 Claims, 24 Drawing Sheets

SELF-LOCKING STRING TUNER AND METHOD THEREFOR

FIELD OF THE INVENTION

The present invention relates in general to a stringed musical instrument and, more particularly, to a self-locking string tuner for a stringed musical instrument and method of making the same.

BACKGROUND OF THE INVENTION

Many musical instruments include strings which the player imparts movement of a string to generate sound. The guitar is a classic stringed musical instrument and comes in a variety of styles and configurations. For acoustic guitars, the string vibration resonates through the body of the guitar to generate sound. In the case of an electric guitar, the audio sound is produced indirectly from the motion of the string, typically steel strings, over a magnetic pickup. The magnetic pickup generates an electrical signal representative of the vibration of the strings. The electrical signal is routed to an audio amplifier to reproduce the original sound.

The strings extend over the guitar body, fret board and bridge, and anchor to a headstock and a tail assembly at opposite ends of the guitar. The strings require tuning for proper acoustic response and playability of the instrument. Tuning pegs are mounted to the headstock. Each string is mounted to a tuning peg, which is rotated to tighten or tune the strings to the desired pitch. In one example, U.S. Pat. No. 4,827,825 describes a tuning peg with core shaft rotating as a string spool shaft by a knob and outer sleeve externally mounted on the core shaft. When a string is passed through a string passing hole and the knob is rotated, the outer sleeve lowers and the string pushing surface pushes the string onto a string receiving surface to lock the string at the desired tension.

Many locking tuners are easy to lock and unlock, as they use a separate manually-operated knob to lock and unlock the tuner. However, a self-locking tuning peg built in the manner of U.S. Pat. No. 4,827,825 is difficult to unlock, particularly with a small diameter string. Also, the outer string post can separate from the inner string post when unlocked, possibly misplacing guitar parts. If the string breaks, additional tools may be required to remove to the string.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
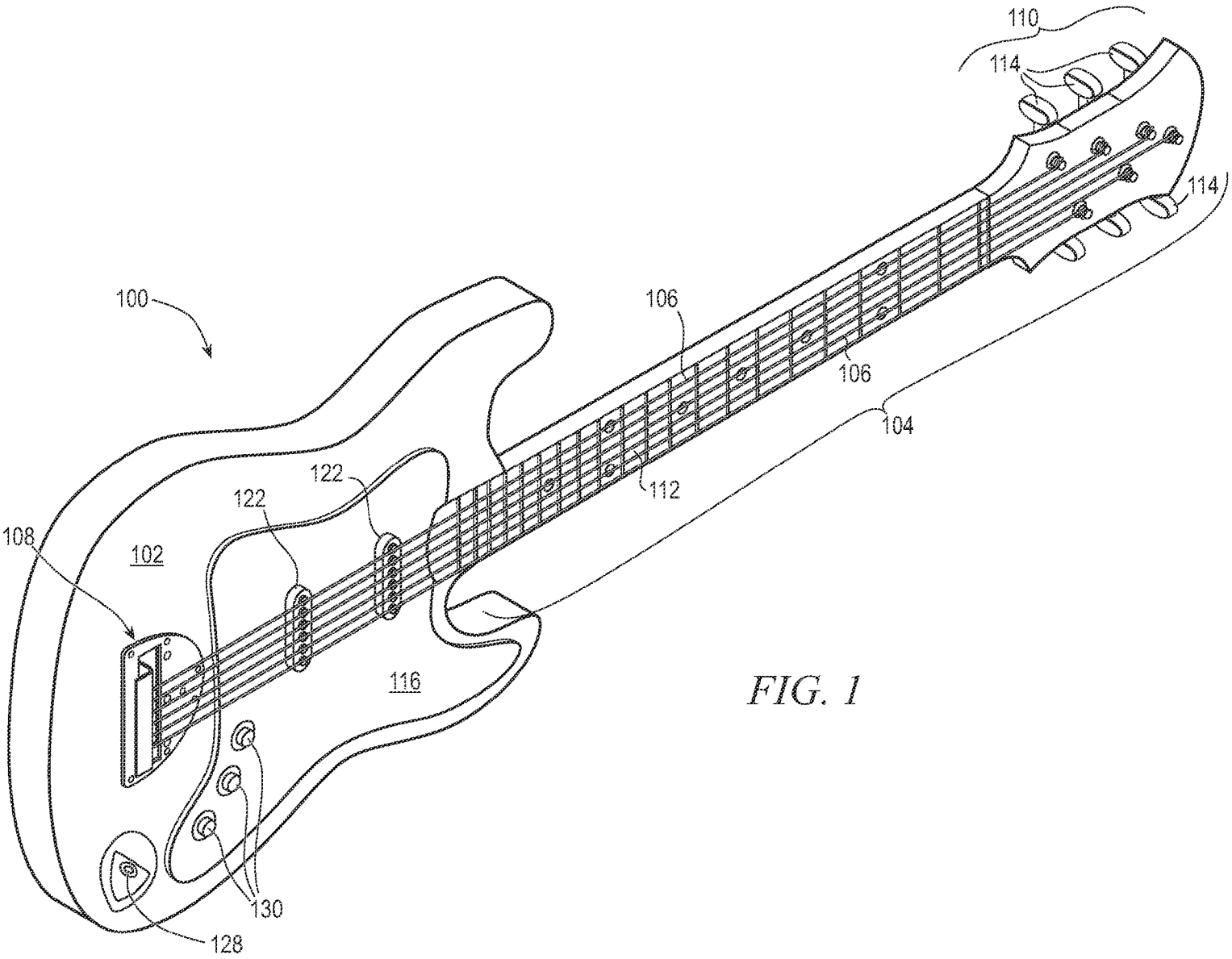
FIG. 1 illustrates a guitar with self-locking tuners in the headstock.

FIG. 1 illustrates guitar 100 including body 102, neck 104, and strings 106. Guitar 100 can be an acoustic guitar, electric guitar, electric bass guitar, ukulele, banjo, or other string musical instrument. A tail assembly 108 is affixed to body 102 using adhesive, screws, clips, or other suitable attachment mechanism. Tail assembly 108 anchors and supports one end of strings 106. Neck 104 includes headstock 110 and fretboard 112. Tuners 114 are attached to headstock 110 and anchor an opposite end of strings 106. As will be described, tuners 114 with an internal string locking mechanism adjust the tension of strings 106. Guitar 100 is tuned in part by turning tuners 114 and engaging the internal string locking mechanism. A pickguard or scratch plate 116 is attached to body 102.

Strings 106 are typically made of steel, nickel, brass, or nylon, and routed from tail assembly 108 over magnetic pickups 122 and fret board 112 to headstock 110. Magnetic pickups 122 are mounted to body 102 using adhesive, screws, clips, or other suitable attachment mechanism. Magnetic pickups 122 are disposed under strings 106 to convert string movement to electrical signals representative of the intended sounds from the vibrating strings. An audio output jack 128 is provided on body 102. The electrical signals generated by magnetic pickups 122 are output from guitar 100 through audio output jack 128. The audio signals and control signals are routed from audio output jack 128 to external devices, e.g., an amplifier and speaker, for signal conditioning and amplification and sound reproduction. Control knobs 130 adjust sound properties, such as volume, bass, and treble.

Figure 2:
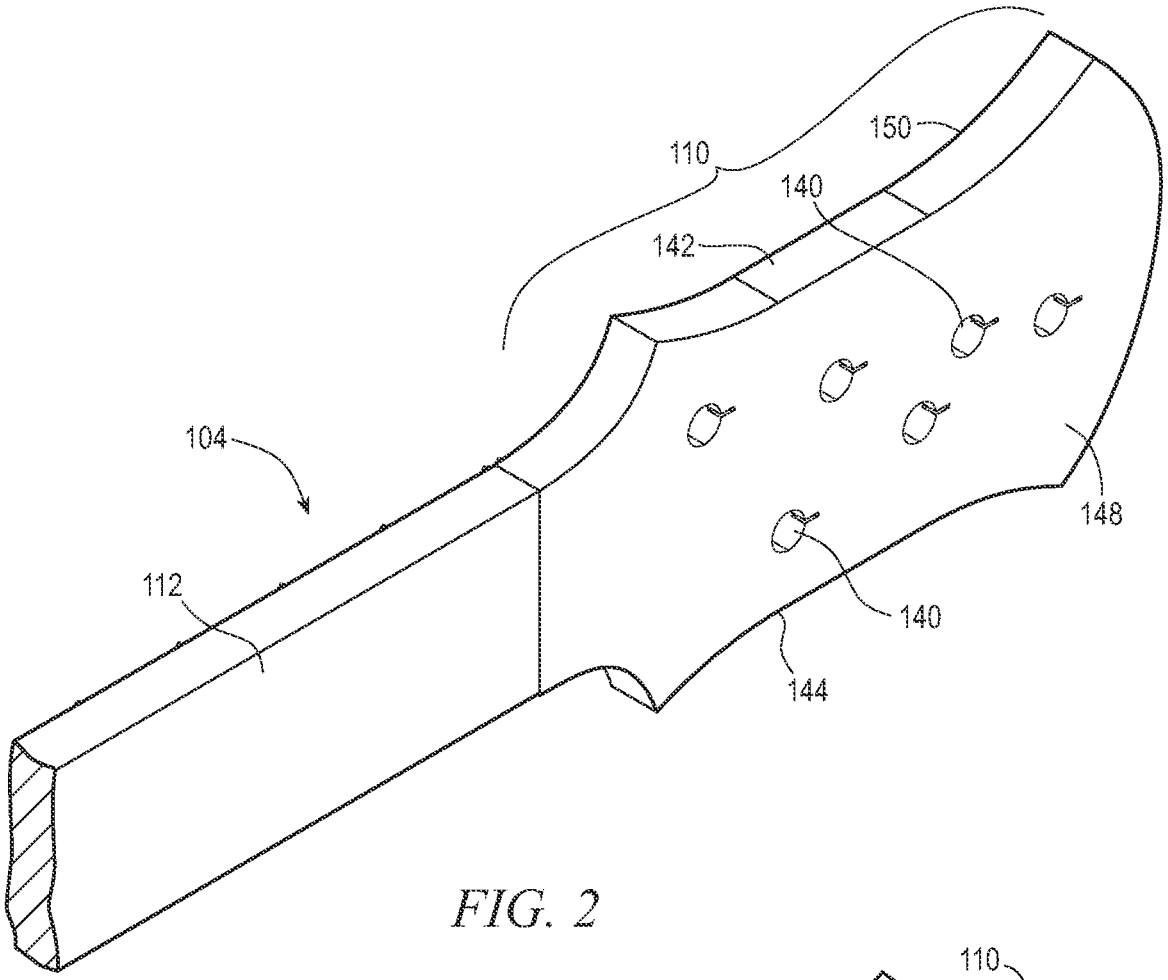
FIG. 2 illustrates further detail of the headboard with holes to receive the self-locking tuners.

FIG. 2 shows further detail of a portion of neck 104 and headstock 110 in an early stage of assembly, i.e., prior to mounting strings 106 and tuners 114. Headstock 110 is typically made of wood or composite polymer material with a thickness of about 15 millimeters (mm). Holes or openings 140 are formed through headstock 110 extending between surface 148 and surface 150. Surface 150 is the string side of headstock 110 and surface 148 is the backside of the headstock.

Figure 3A:
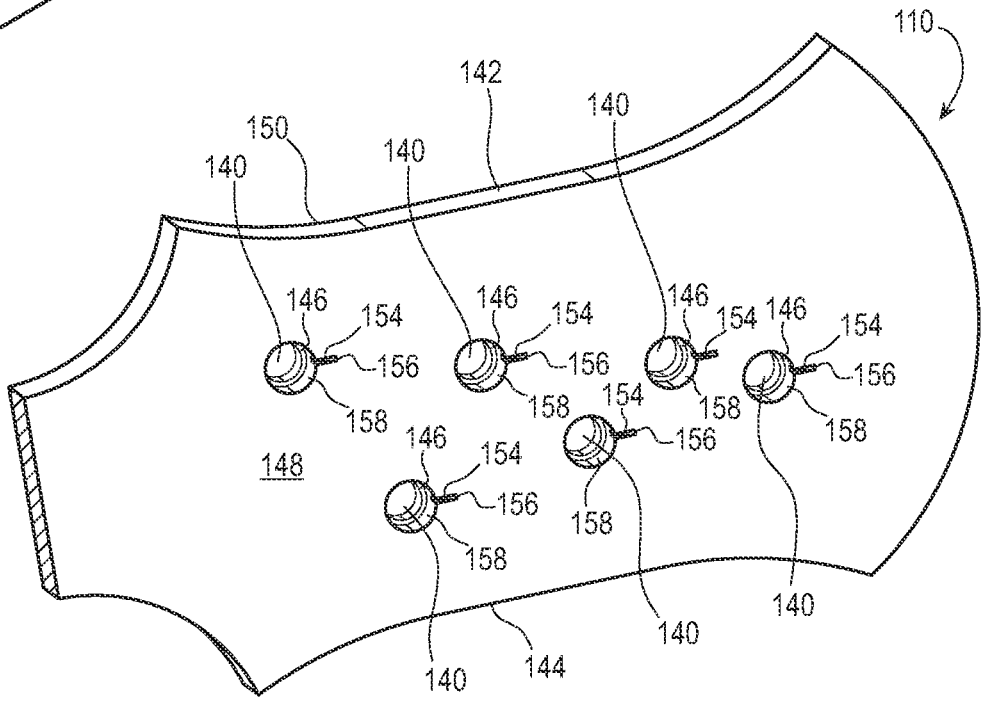
FIGS. 3*a*-3*f* illustrate formation of the holes in the headstock and inserts installed in the holes.
Figure 3B:
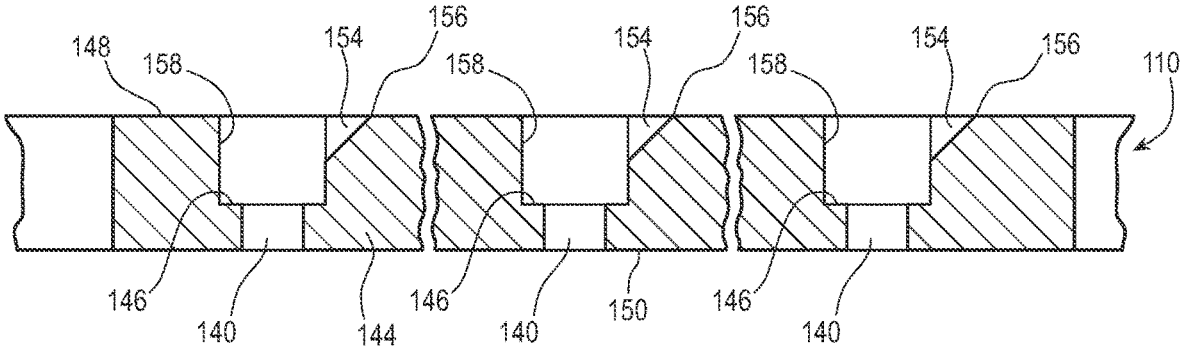

FIG. 3*a* illustrates hole 140 extending through headstock 110 with step 146 providing an internal support ridge about midway through the thickness of the headstock. Step 146 is formed by making hole 140 larger from surface 148, and smaller from surface 150. A kerf or notch 154 is formed in surface 148 of headstock 110 starting from point 156 away from hole 140 and extending on a slope to inner surface 158. Notch 154 can also be a rectangular, semi-circle, curved, or any other shape cutout that provides an anchor point to prevent insert 160 from turning within hole 140. FIG. 3*b* shows a side view of headstock 110 with holes 140, step 146, and kerf 154.

Figure 3C:
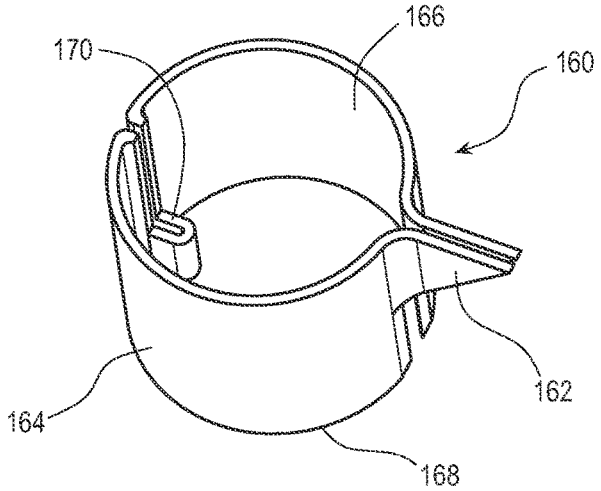
Figure 3D:
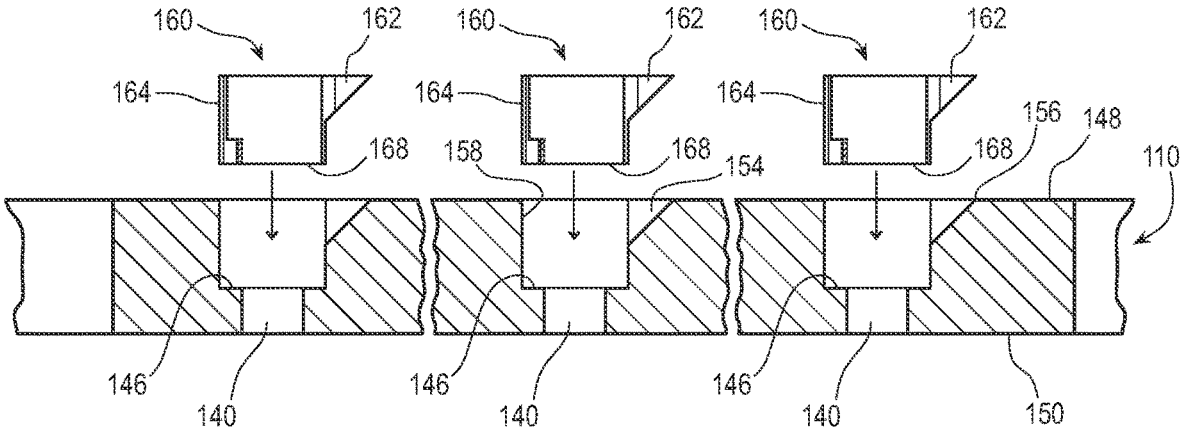
Figure 3E:
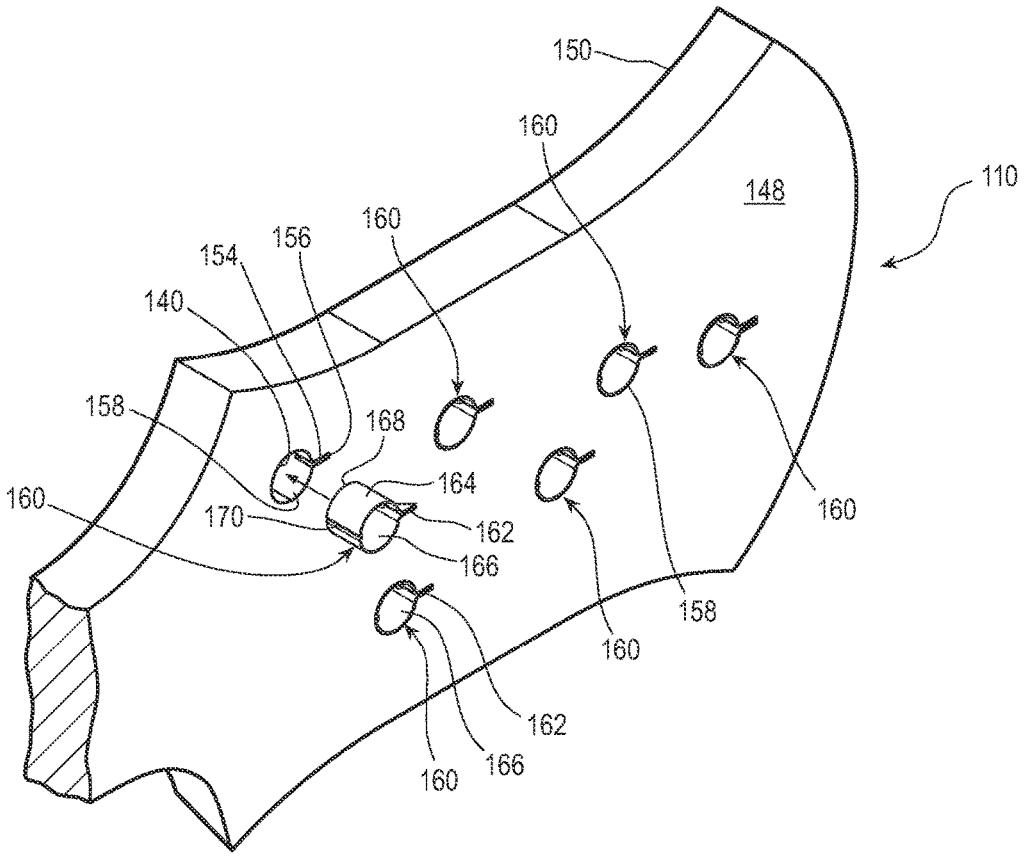
Figure 3F:
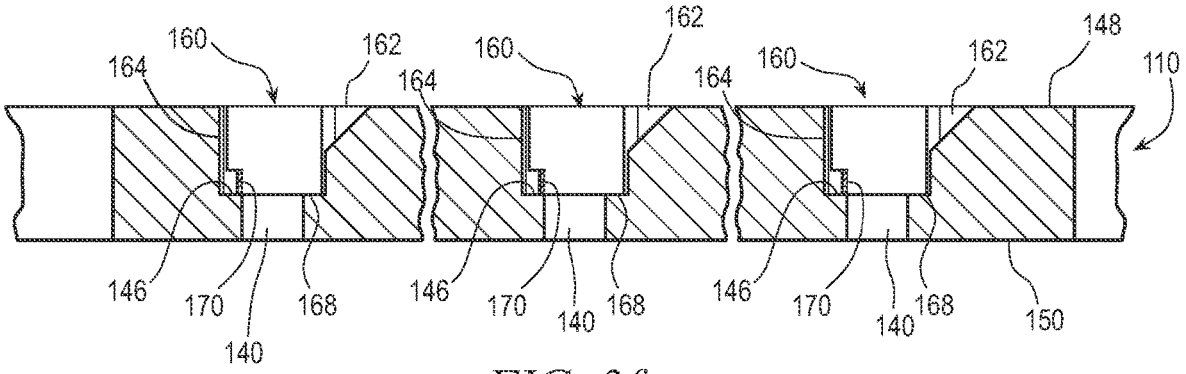

FIG. 3*c* illustrates insert 160 with tab 162 and outer surface 164, inner surface 166, bottom ring 168, and combo stop 170. In FIG. 3*d*, inserts 160 are disposed over and press fit into each hole 140. FIG. 3*e* shows inserts 160 disposed in holes with surface 164 of insert 160 contacting surface 158, and tab 162 in kerf 154. FIG. 3*f* shows a side view of insert 160 disposed within hole 140 with bottom ring 168 in contact with step 146, and tab 162 in kerf 154.

Headstock 110 contains one tuner 114 for each hole 140 and insert 160 and for each string 106 to lock the string to the tuning post. Tuners 114 can be made in left hand and right hand versions of the thread direction of the inner string post 192 and outer string post 198. Right hand thread for the left hand side of headstock 110, and left hand thread for the right hand side of the headstock. The worm and gear mechanism is the same for both left and right tuners 114, with reverse bodies.

Figure 4A:
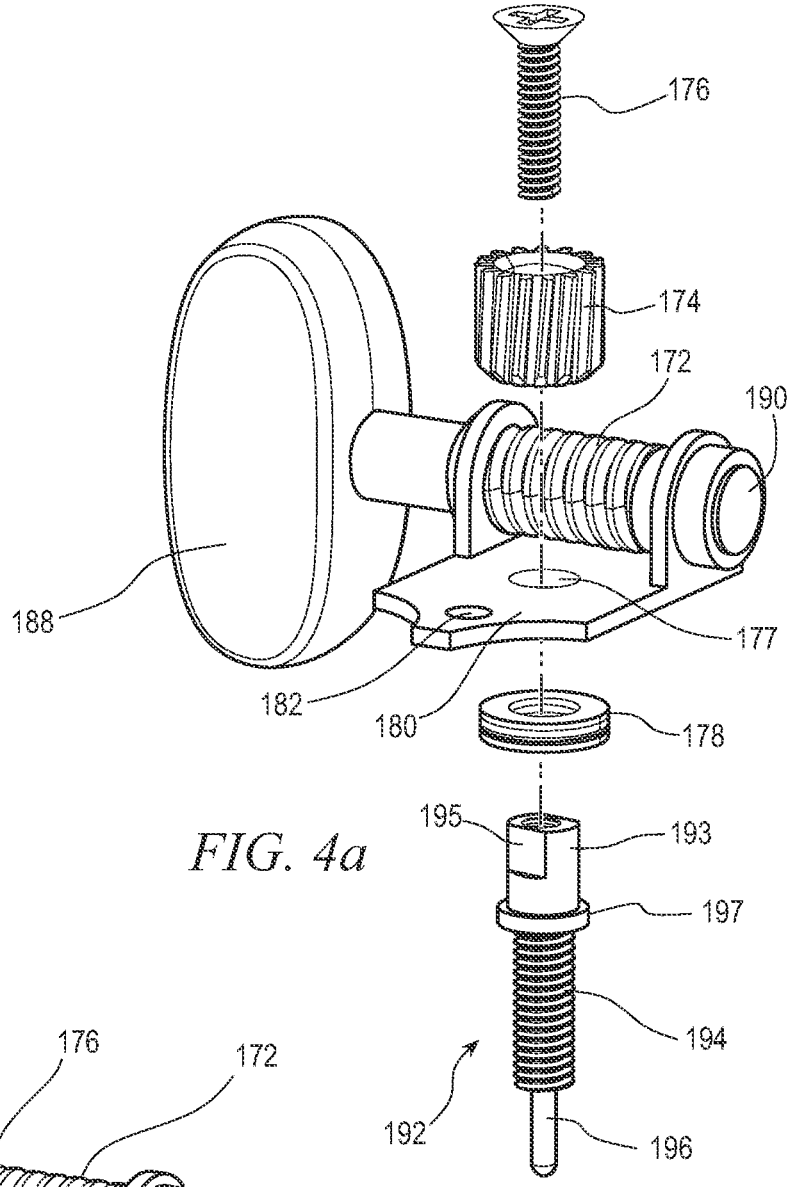
FIGS. 4*a*-4*j* illustrate assembly and operation of the self-locking tuner.
Figure 4B:
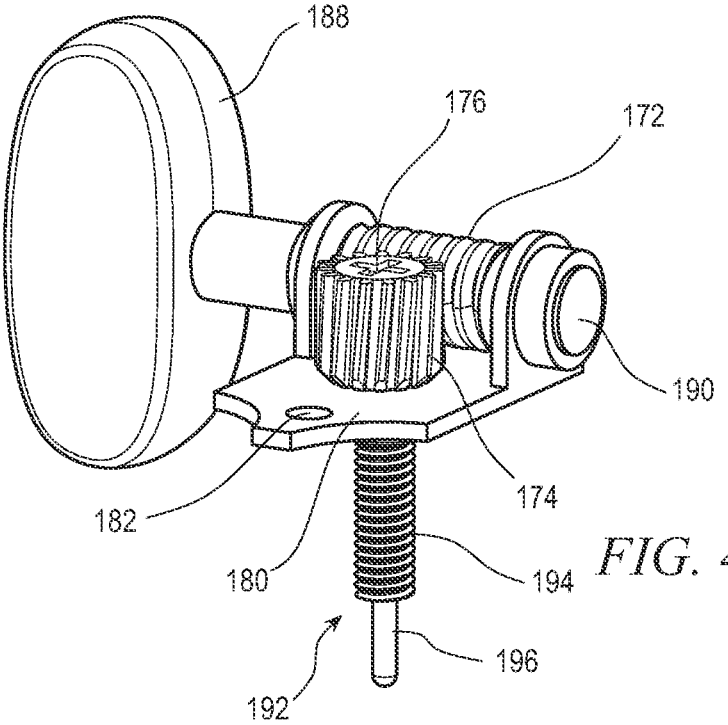

FIGS. 4*a*-4*j* illustrate further detail of one embodiment of self-locking tuner 114 including mounting plate 180 with openings 182 for mounting to surface 150 of headstock 110 with screws or other attachment mechanism. In FIG. 4*a*, tuning knob 188 with shaft 190 rotates worm gear 172. Gear 174 is placed over mounting plate 180 in contact with worm gear 172. Screw 176 inserts through gear 174, opening 177 of mounting plate 180, washer 178, and screws into inner threads of inner string post 192. The underside of gear 174 includes an opening mated to post 193 of inner string post 192. Post 193 includes notched surface 195 to mate with a corresponding slot in gear 174. Post 193 includes flange 197 and threads 194. Locking pin 196 extends from post 193. Turning tuning knob 188 turns shaft 190, which turns worm gear 172 and gear 174. Gear 174 turns post 193 and inner string post 192 by nature of notched surface 195. FIG. 4*b* shows gear 174 secured to worm gear 172 and inner string post 192 with screw 176. The rotation of tuning knob 188 turns shaft 190 and worm gear 172, which rotates gear 174, and turns inner string post 192 by nature of notched surface 195.

Figure 4C:
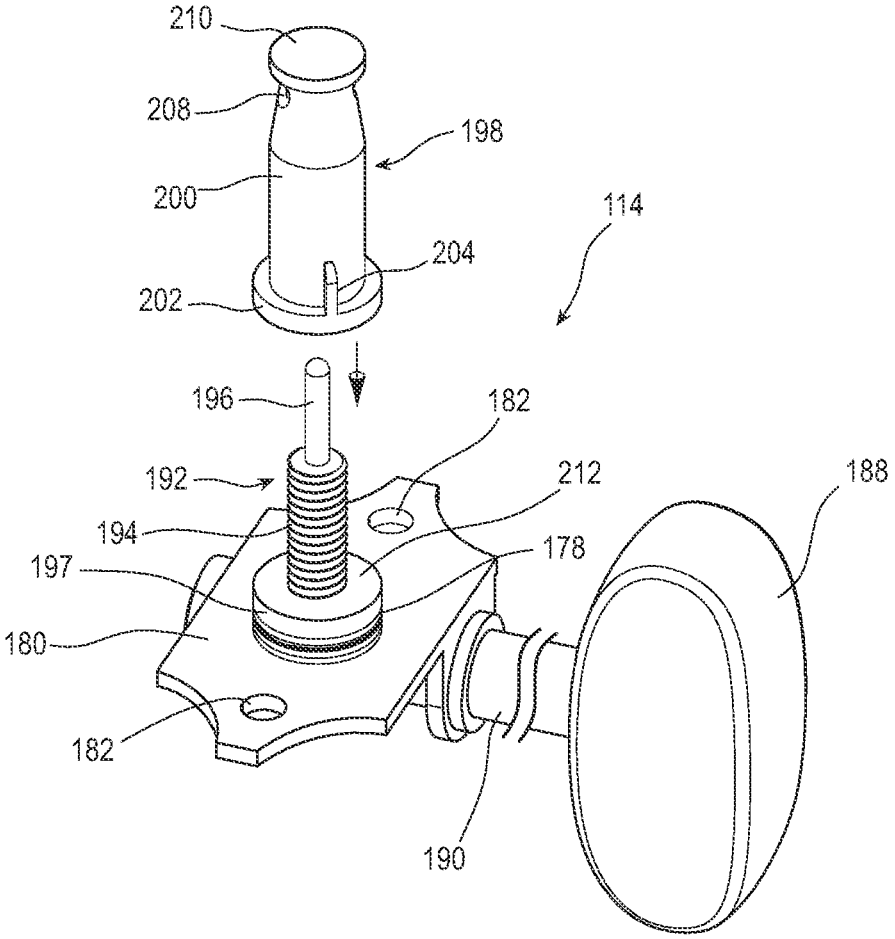

In FIG. 4*c*, inner string post 192 includes threads 194. Locking pin 196 extends from inner string post 192. Outer string post 198 includes housing 200 and lower flange 202 with outer string post rotational stop 204. Housing 200 includes opening 208, which string 106 will pass through, and upper cap 210. Outer string post 198 is disposed over to mate with inner string post 192 and locking pin 196. Housing 200 has internal threads corresponding to threads 194. Outer string post 198 is threaded onto inner string post 192 by rotating the outer string post with respect to the inner string post. Locking pin 196 should contact the top of opening 208 before the threads of outer string post 198 cause contact between flange 202 and surface 212 of flange 197.

Figure 4D:
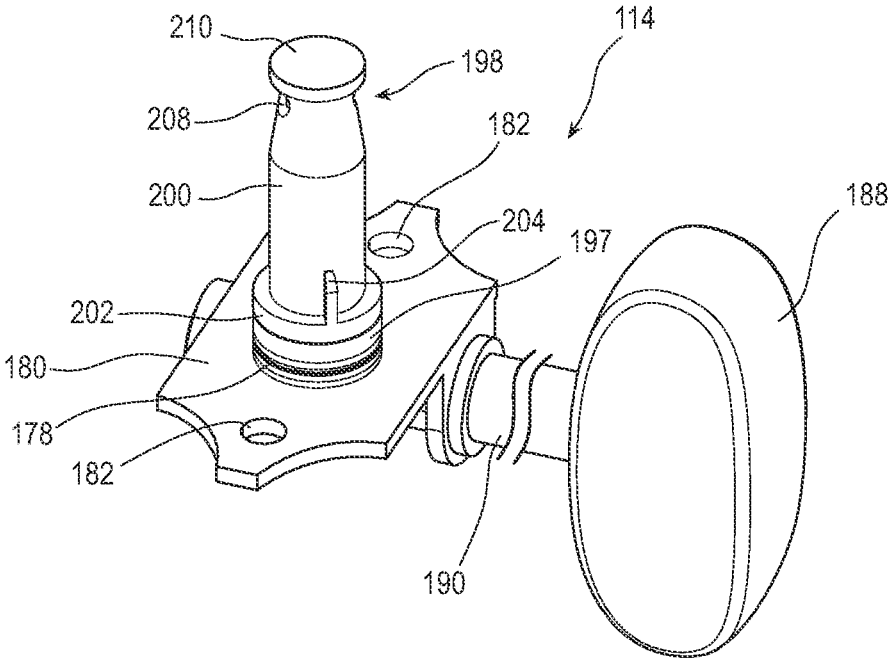

FIG. 4*d* shows outer string post 198 mated with inner string post 192 and locking pin 196. Tuning knobs 188 extend out from headstock 110 proximate to surface 142 and surface 144. String 106 will be inserted through opening 208. Tuning knob 188 rotates inner string post 192, which screws into outer string post 198 until locking pin 196 pinches string 106 against the upper surface of opening 208. Outer string post 198 then rotates to apply tension to string 106. The resulting increase in string tension increases the grip between string 106 and the top surface of opening 208.

Figure 4E:
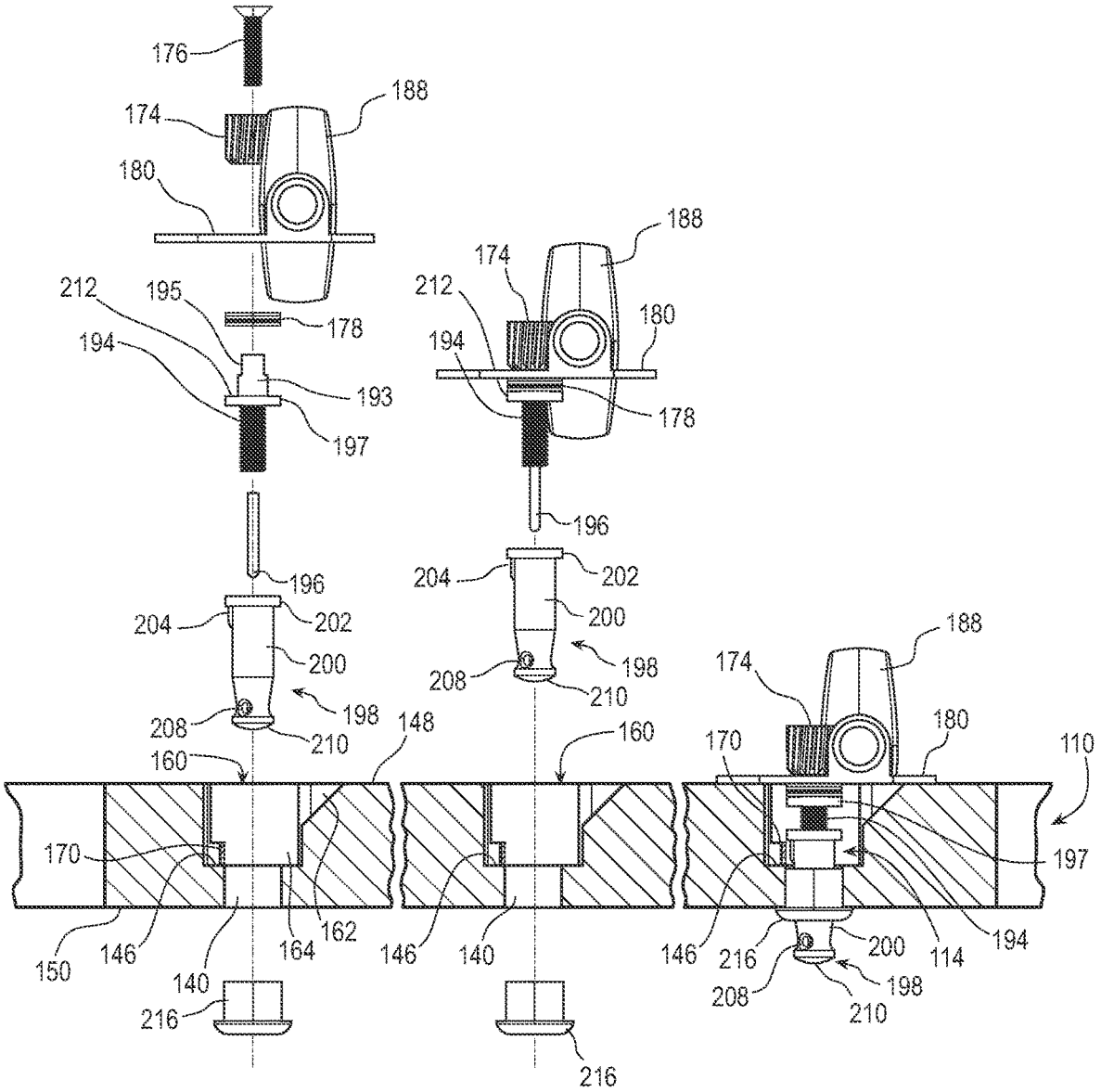

FIG. 4*e* shows various stages of tuner 114 assembled within hole 140 in headstock 110. Gear 174 mates with worm gear 172. Post 193 is inserted through washer 178 and hole 177 of plate 180 so that notched surface 195 slides into corresponding notched surface in gear 174. Screw 176 holds gear 174 and post 193 together. Locking pin 196 extends from threads 194. Outer string post 198 is threaded onto threads 194 of inner string post 192 prior to inserting into tuner 114 into hole 140. The combined inner string post 192 and outer string post 198 is placed within hole 140 and insert 160. Collar 216 is disposed around housing 200 to hold tuner 114 firmly in place within hole 140. Collar 216 is press fit into opening 140 to act as a bearing for the loaded string post. Tuner 114 is held in place with screws via hole 182 in mounting plate 180.

Figure 4F:
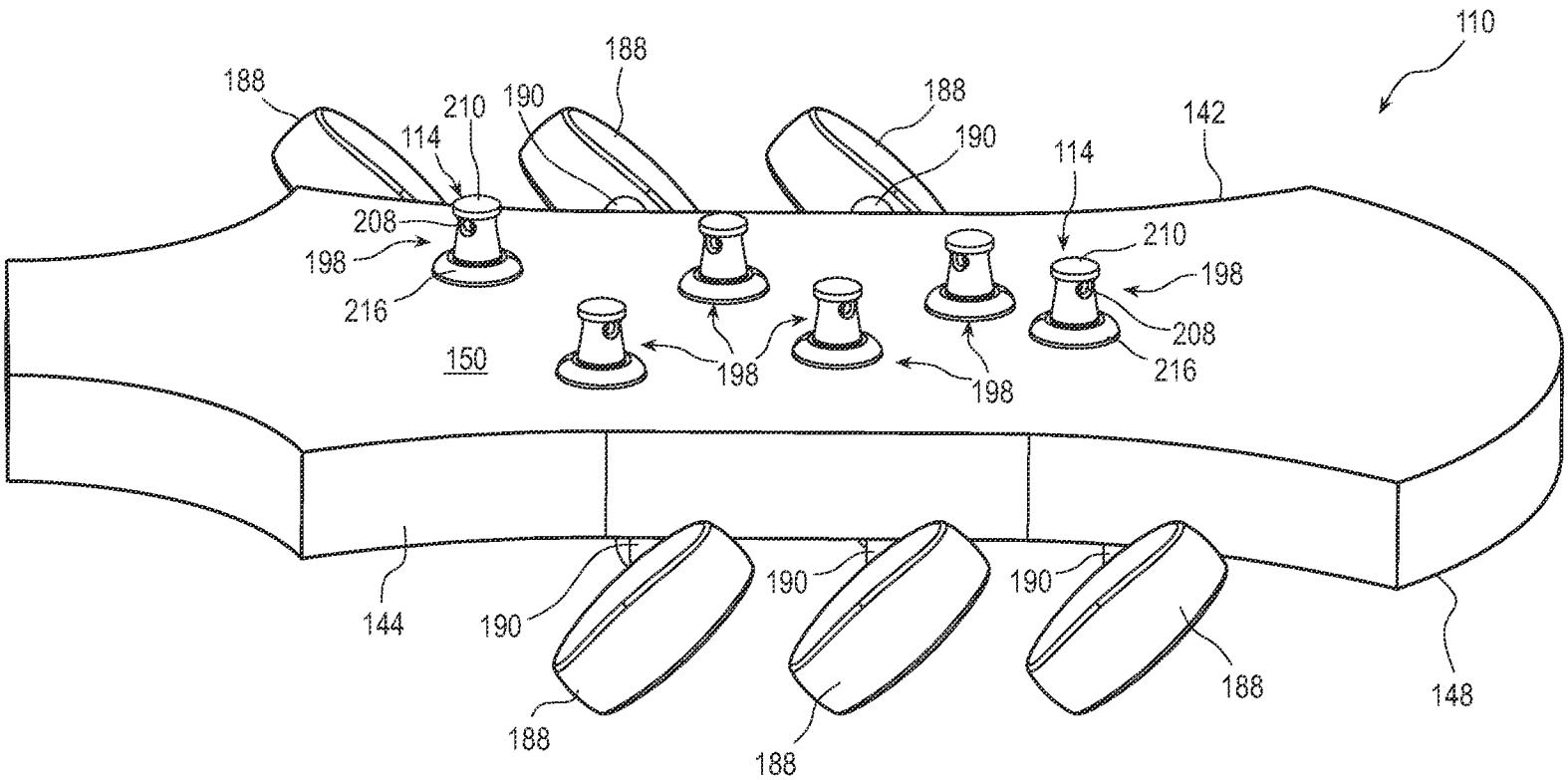

FIG. 4*f* shows tuner 114 mounted to headstock 110 with mounting plate 180 affixed to surface 148 with screws through openings 182 and into the headstock, or other attachment mechanism. Housing 200 is disposed within insert 160 and through opening 140 in headstock 110.

Figure 4G:
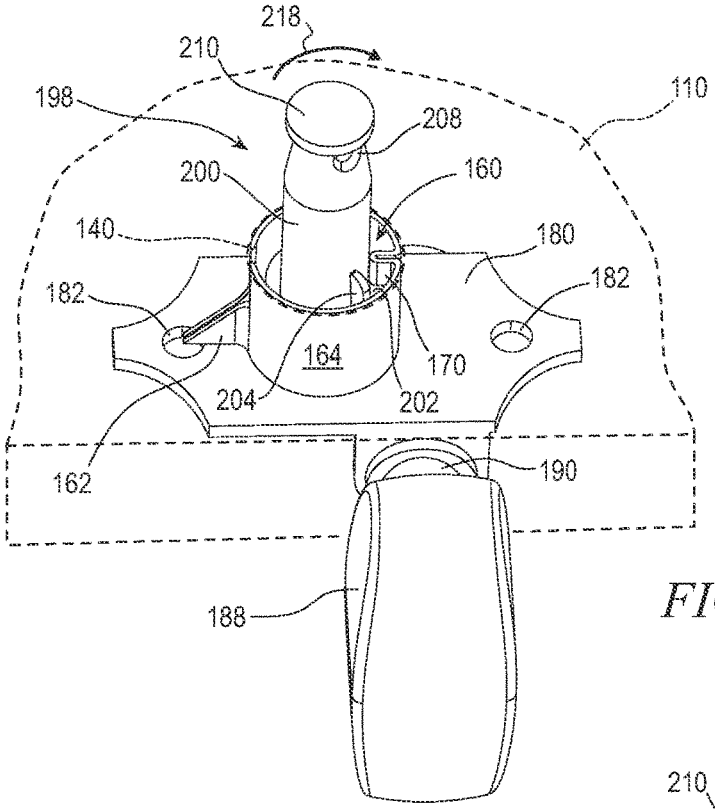
Figure 4H:
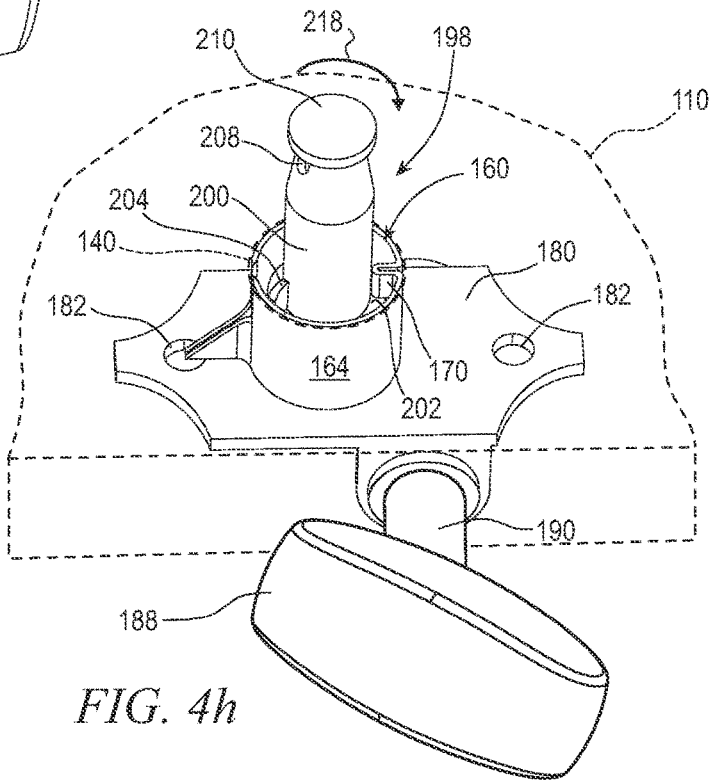

FIG. 4*g* illustrates further detail of housing 200 as disposed within insert 160, as headstock 110 is transparent. Tuner 114 in FIG. 4*g* is a right side tuner with left hand string post threads. Arrow 218 shows the direction of string spooling. Tuning knob 188 rotates inner string post 192 until locking pin 196 contacts string 106 and presses the string against the top of opening 208, as shown in FIG. 4*h*. Further turning of tuning knob 188 rotates outer string post 198 in the direction of arrows 218 and tightens string 106 by rotating opening 208 against the string to tune the vibrating frequency of the string. Combo stop 170 and insert 160 further operates to keep inner string post 192 and outer string post 198 from becoming separated. If outer string post 190 is unthreaded enough, combo stop 170 and collar 202 come into contact, stopping further unthreading.

Figure 4I:
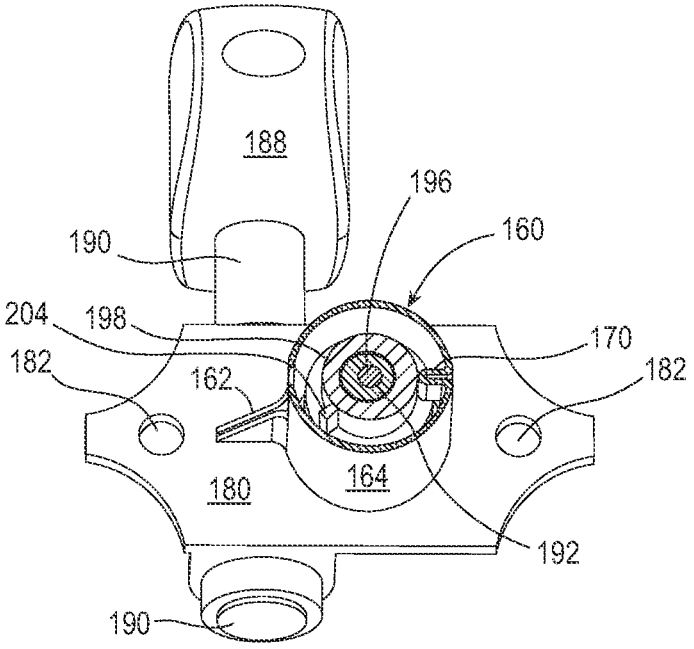
Figure 4J:
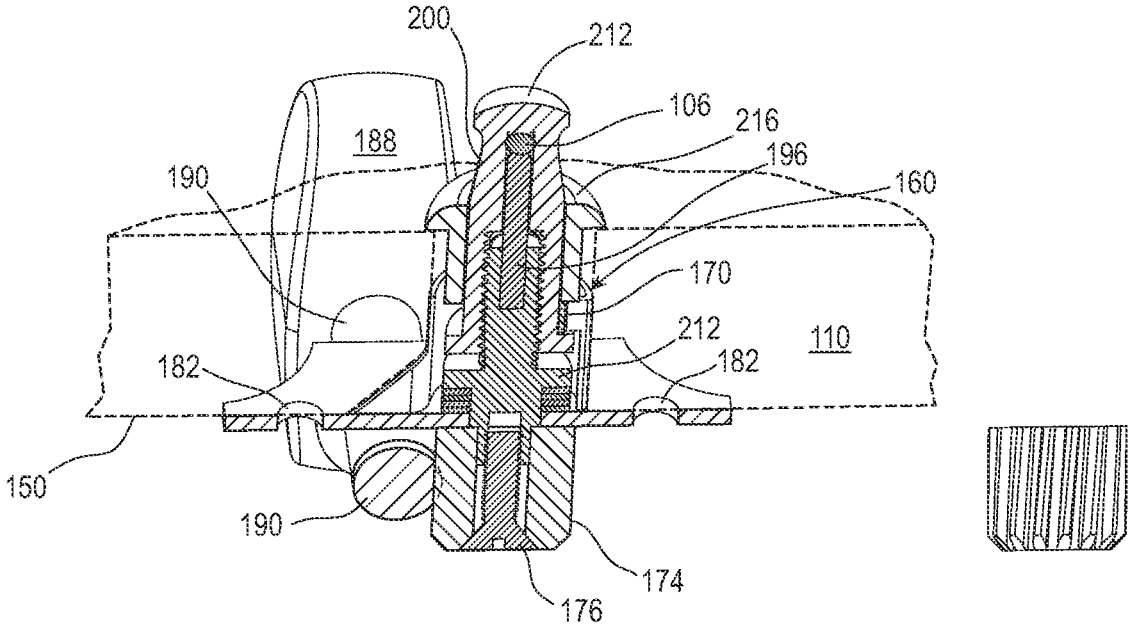

FIG. 4*i* illustrates a horizontal cutaway view of internal components of tuner 114. In particular, locking pin 196 is disposed within inner string post 192, and inner string post 192 is disposed within outer string post 198. FIG. 4*j* illustrates a vertical cutaway view of the internal components of tuner 114. Locking pin 196 is disposed within inner string post 192, and inner string post 192 is disposed within outer string post 198. Combo stop 170 prevents inner string post 192 and outer string post 198 from becoming separated.

Figure 5:
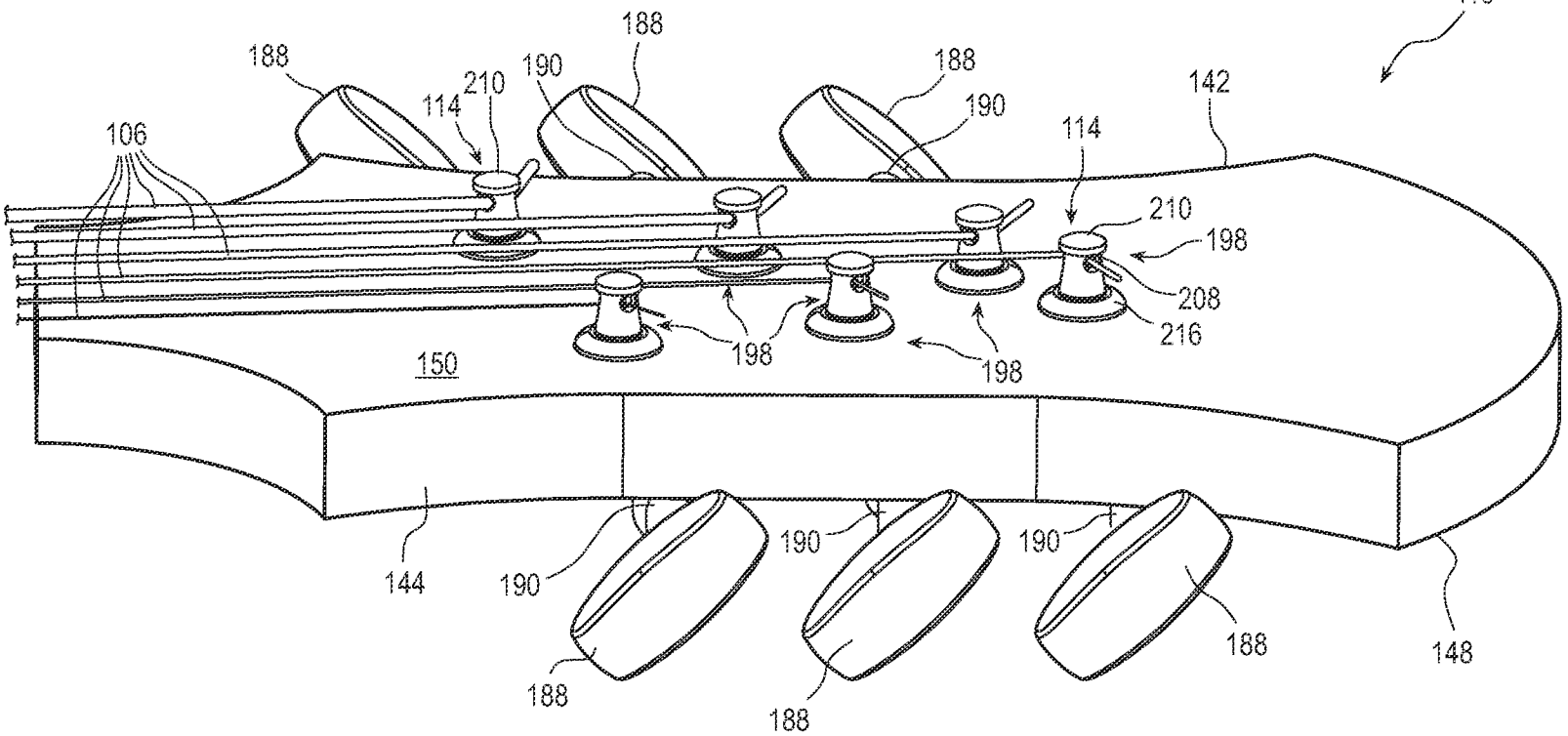
FIG. 5 illustrates the self-locking tuner disposed on the headstock.
Figure 6A:
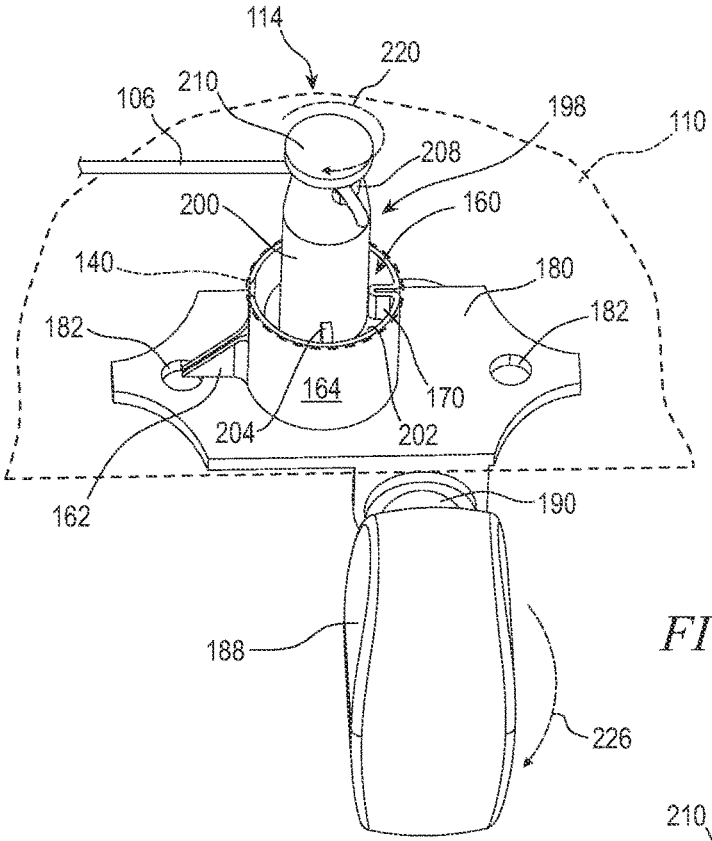
FIGS. 6*a*-6*c* illustrate the insert type self-locking tuners tuning the strings.
Figure 6B:
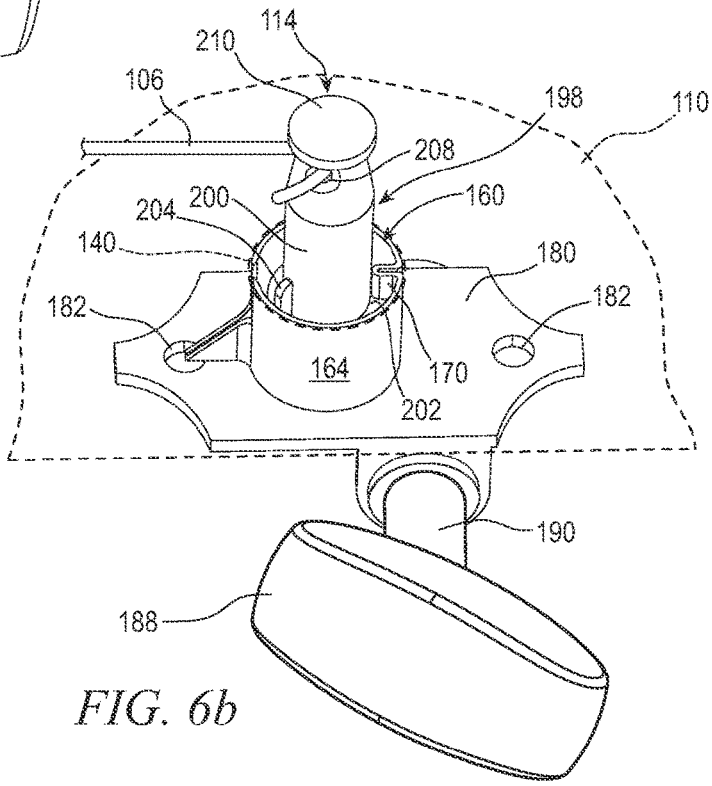

FIG. 5 illustrates tuners 114 mounted to headstock 110 and strings 106 routed through holes 208 for tuning. FIG. 6*a* shows further detail of one string 106 routed through one tuner 114. Tuning knob 188 uses a worm and gear mechanism within shaft 190 to rotate inner string post 192 and outer string post 198. Inner string post 192 is firmly affixed to the worm gear with a screw. Rotating tuning knob 188 counter-clockwise in a right hand tuner rotates outer string post 198 clockwise in the direction of arrow 220 to tighten the string. In the case of a left hand tuner, rotating tuning knob 188 counter-clockwise rotates outer string post 198 counter-clockwise to tighten the string. However, outer string post 198 does not begin turning until threads 194 of inner string post 192 are sufficiently screwed into the mating threads of outer string post 198 so that locking pin 196 presses string 106 to lock the string against upper cap 210, see FIG. 4*h*. A left-handed tuner 114 uses right-handed threads to engage locking pin 196. A right-handed tuner 114 uses left-handed threads to engage locking pin 196. When locking pin 196 locks string 106 against upper cap 210, outer string post 198 begins to rotate in the direction of arrow 220 to pull or stretch the string. Tab 162, as disposed in kerf 154, keeps insert 160 from turning within hole 140. String 106 resists the rotation of outer string post 198 and tightens the pressure between the outer string post, string and locking pin 196. String 106 does not slip under locking pin 196 in tuner 114. Once locking pin 196 is set, continuing to turn tuning knob 188 rotates outer string post 198 in the direction of arrow 220 to pull or stretch string 106, as shown in FIG. 6*b*. The pulling or stretching of string 106 due to the turning of tuning knob 188 and resulting rotation of outer string post 198 tightens string 106 and alters its frequency of vibration, i.e., pitch of the string being tuned. Accordingly, tuning knob 188 can be turned in either direction to set the desired pitch of strings 106.

Figure 6C:
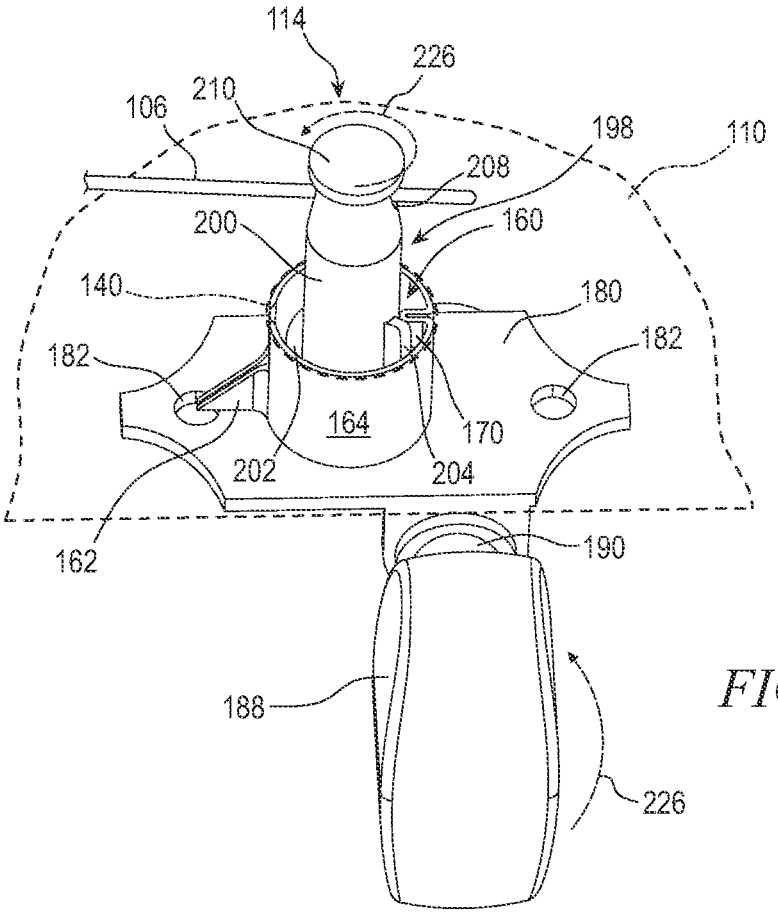

To remove string 106 from tuner 114, tuning knob 188 is turned to rotate outer string post 198 counter-clockwise in the direction of arrow 226 to rotate inner string post 192 with locking pin 196 until outer string post rotational stop 204 contacts combo stop 170 on insert 160, as shown in FIG. 6*c*. Insert 160 remains fixed in place by tab 162 disposed in kerf 154, see FIG. 4*f*. As outer string post rotational stop 204 contacts combo stop 170, any further turning of tuning knob 188 loosens threads 194 and draws down locking pin 196. String 106 can then be removed from opening 208. Further clockwise turning of tuning knob 188 brings collar 202 into contact with combo stop 170, preventing outer string post 198 and inner string post 192 from becoming separated.

Figure 7A:
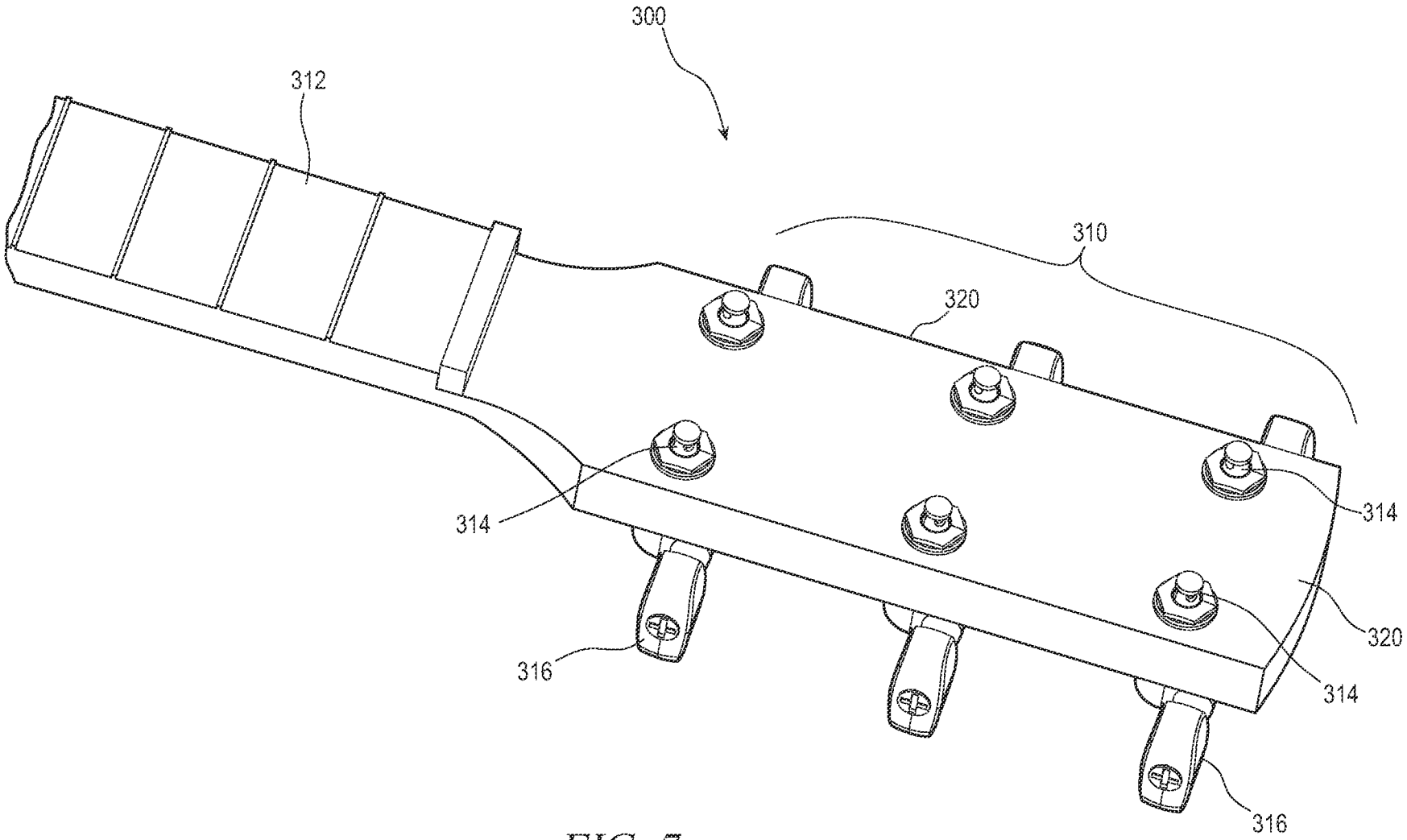
FIGS. 7*a*-7*b* illustrate another embodiment of self-locking tuners in the headstock.
Figure 7B:
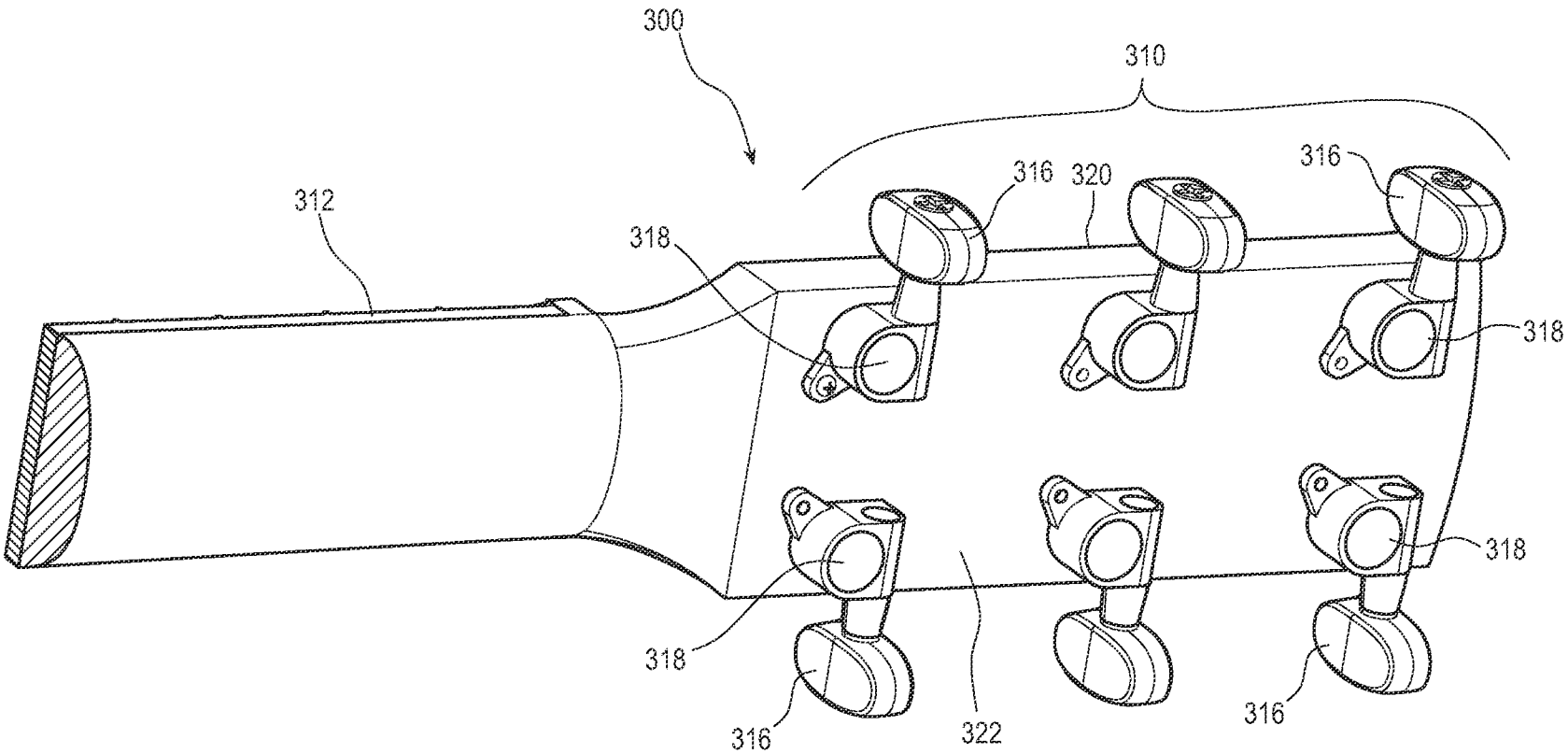

In another embodiment, the self-locking tuner can be integrated into the base of the tuner. FIG. 7*a* illustrates a portion of guitar 300 including headstock 310 and fretboard 312. Sealed, self-locking, and self-unlocking tuners 314 are disposed through headstock 310 and extend above surface 320. As will be described, sealed tuners 314 with an internal string locking mechanism adjust the tension of the strings. Guitar 300 is tuned in part by turning tuning knobs 316 and engaging the internal string locking mechanism. FIG. 7*b* shows a backside view of headstock 310 and fretboard 312. Tuning knobs 316 connect to base 318 in contact with surface 322 and containing the self-locking tuner.

Figure 8:
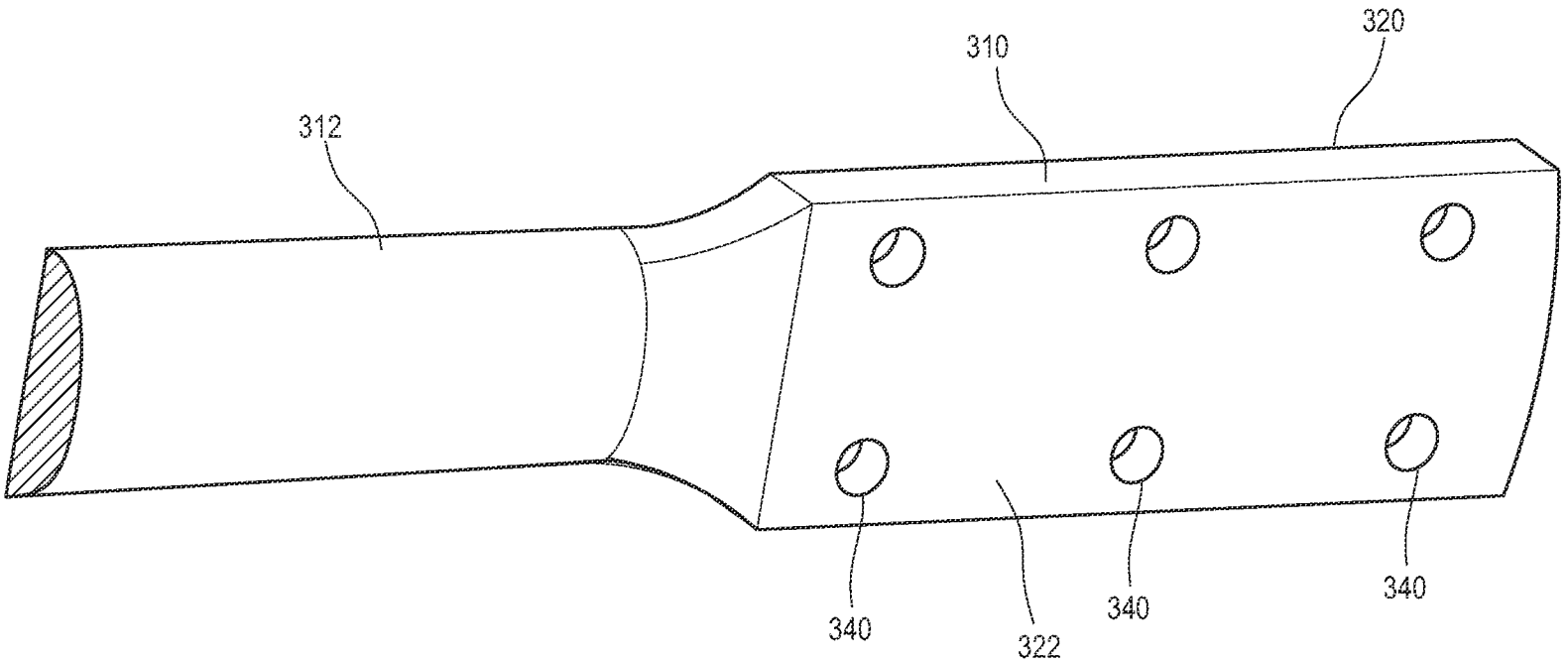
FIG. 8 illustrates further detail of the headboard with holes to receive the self-locking tuners.

FIG. 8 shows further detail of a portion of headstock 310 and fretboard 312 in an early stage of assembly, i.e., prior to mounting tuners 314. Headstock 310 is typically made of wood or composite polymer material with a thickness of about 15 mm. Holes or openings 340 are formed through headstock 310 extending between surface 320 and surface 322. Surface 320 is the string side of headstock 310 and surface 322 is the backside of the headstock.

Figure 9A:
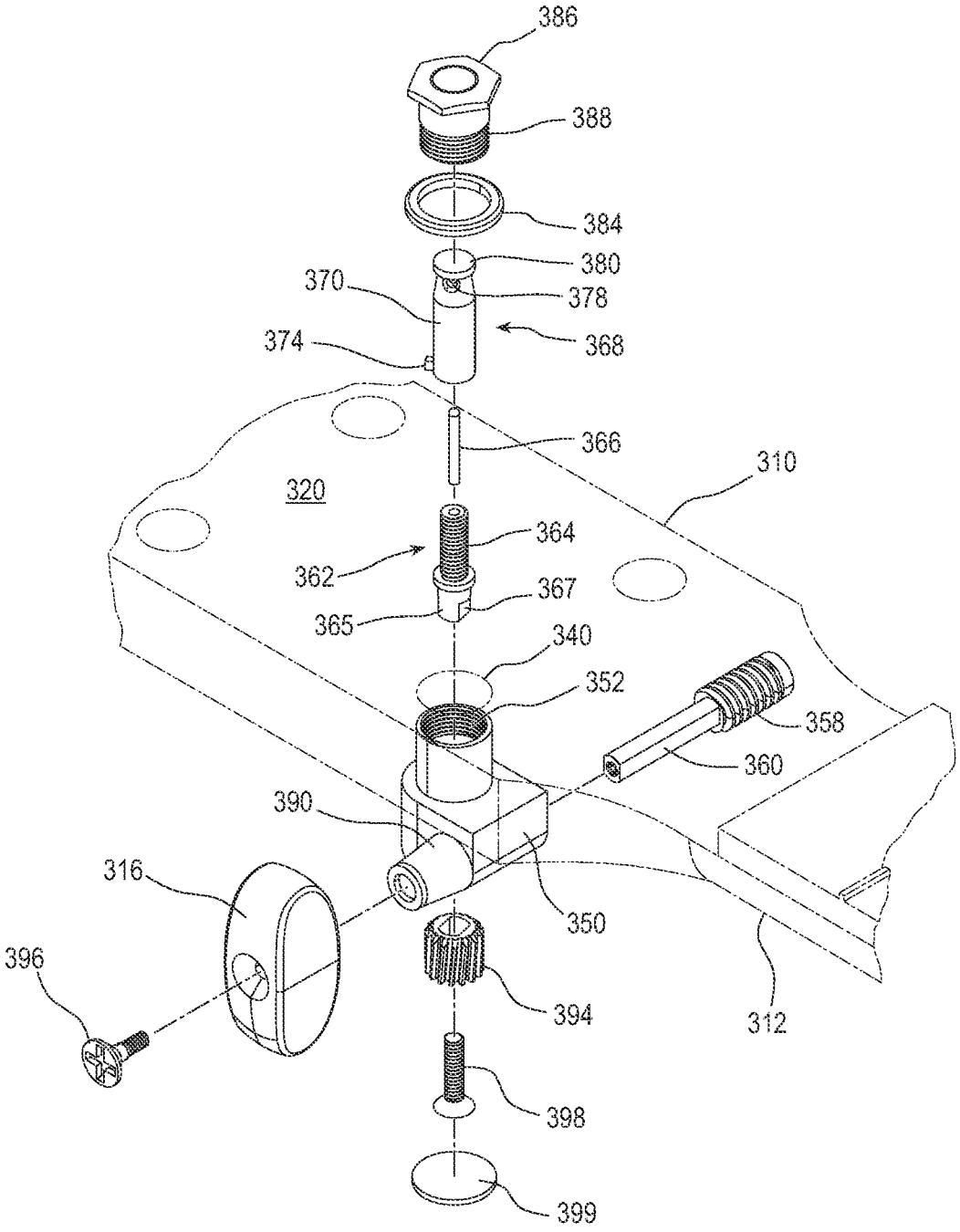
FIGS. 9*a*-9*b* illustrate assembly of the self-locking tuner.

Headstock 310 contains one sealed, self-locking tuner 314 for each hole 340 and for each string to lock the string to the tuning post. FIG. 9*a* is an exploded view of tuner 314. Cast housing 350 includes opening 352 to receive inner string post 362 with threads 364. Post 365 with notched surface 367 passes through opening 352 in case housing 350 and mates with a corresponding notched surface on gear 394. Locking pin 366 extends from inner string post 362. Outer string post 368 includes housing 370 with outer string post rotational stop tab 374. Housing 370 includes opening 378, which the guitar string will pass through, and upper cap 380. Outer string post 368 is disposed over to mate with inner string post 362 and locking pin 366. Housing 370 has internal threads corresponding to threads 364. Outer string post 368 is threaded onto inner string post 362 by rotating the outer string post with respect to the inner string post. Washer 384 contact surface 320 of headstock 310. Locking head 386 with threads 388 screws into corresponding threads in opening 352 of cast housing 350.

Worm gear 358 with shaft 360 is disposed through cast housing 350 and tuning knob 316. Tuning knob 316 is connected to beveled surface 390 and secured with screw 396 into shaft 360. Gear 394 is inserted into cast housing 350 and secured with screw 398 into inner string post 362 and covered with cap 399. The gear teeth of gear 394 contacts the gear teeth of worm gear 358 inside cast housing 350. Turning tuning knob 316 turns shaft 360 and worm gear 358, which turns gear 394 and inner string post 362.

Figure 9B:
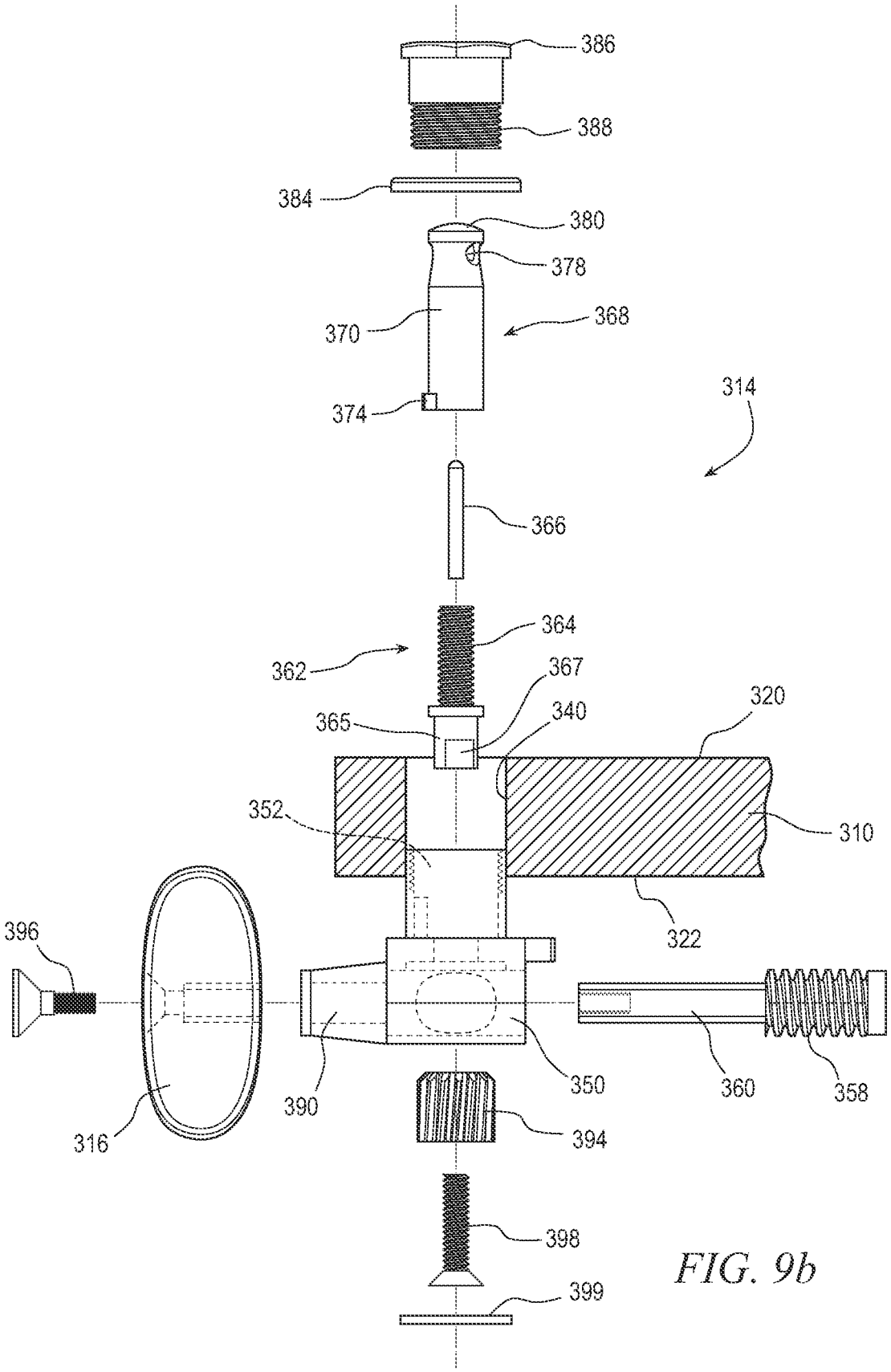

FIG. 9*b* is a side exploded view of tuner 314. Cast housing 350 includes opening 352 to receive inner string post 362 with threads 364. Post 365 with notched surface 367 passes through opening 352 in cast housing 350 and mates with a corresponding notched surface on gear 394. Locking pin 366 extends from inner string post 362. Outer string post 368 includes housing 370 with outer string post rotational stop 374. Housing 370 includes opening 378, which the guitar string will pass through, and upper cap 380. Outer string post 368 is disposed over to mate with inner string post 362 and locking pin 366. Housing 370 has internal threads corresponding to threads 364. Outer string post 368 is threaded onto inner string post 362 by rotating the outer string post with respect to the inner string post. Washer 384 contact surface 320 of headstock 310. Locking head 386 with threads 388 screws into corresponding threads in opening 352 of cast housing 350.

Worm gear 358 with shaft 360 is disposed through cast housing 350 and tuning knob 316. Tuning knob 316 is connected to beveled surface 390 and secured with screw 396 into shaft 360. Gear 394 is inserted into cast housing 350 and secured with screw 398 into inner string post 362 and covered with cap 399. The gear teeth of gear 394 contacts the gear teeth of worm gear 358 inside cast housing 350. Turning tuning knob 316 turns shaft 360 and worm gear 358, which turns gear 394 and inner string post 362.

Figure 10A:
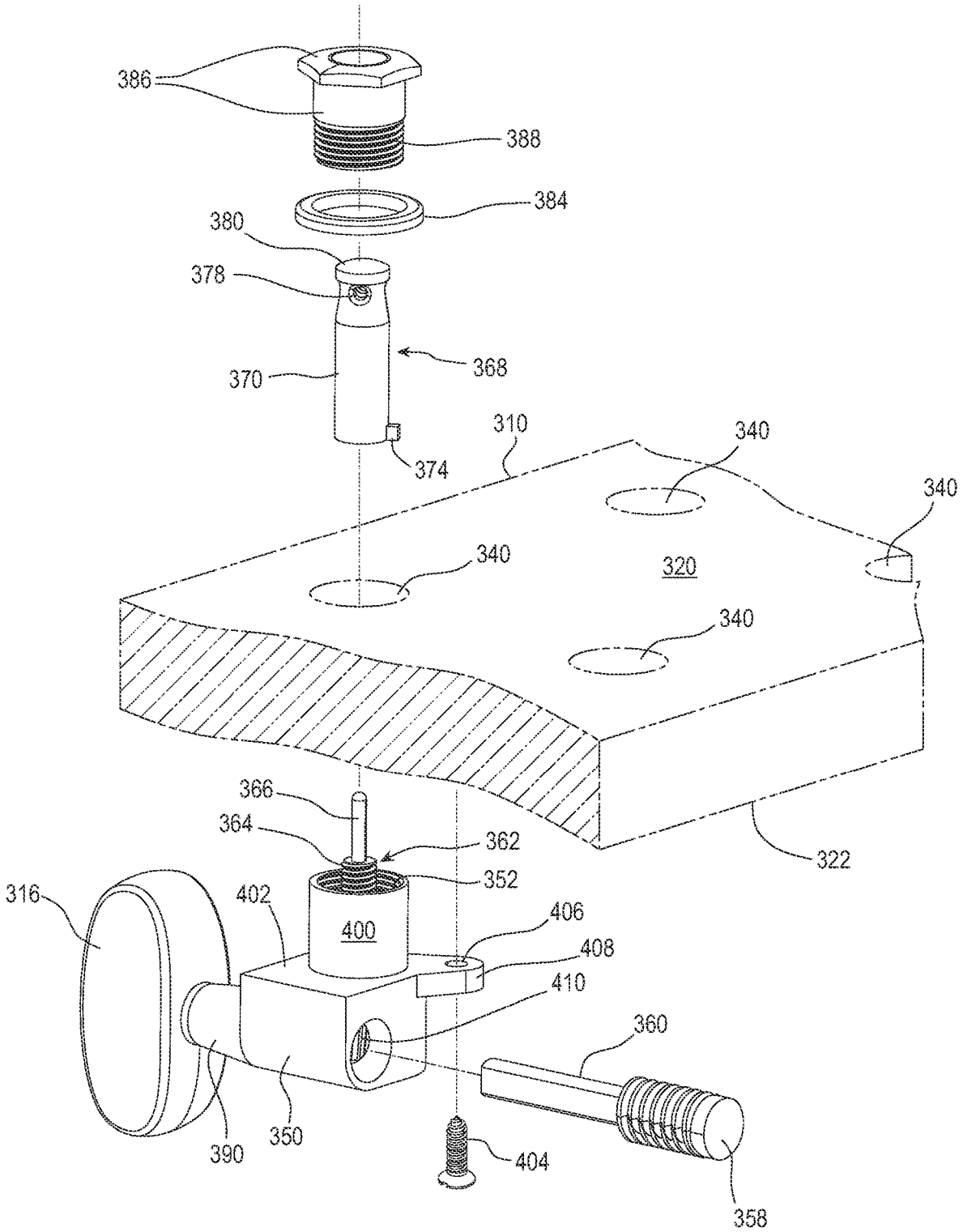
FIGS. 10*a*-10*c* illustrate further detail of the assembly of the self-locking tuner.
Figure 10B:
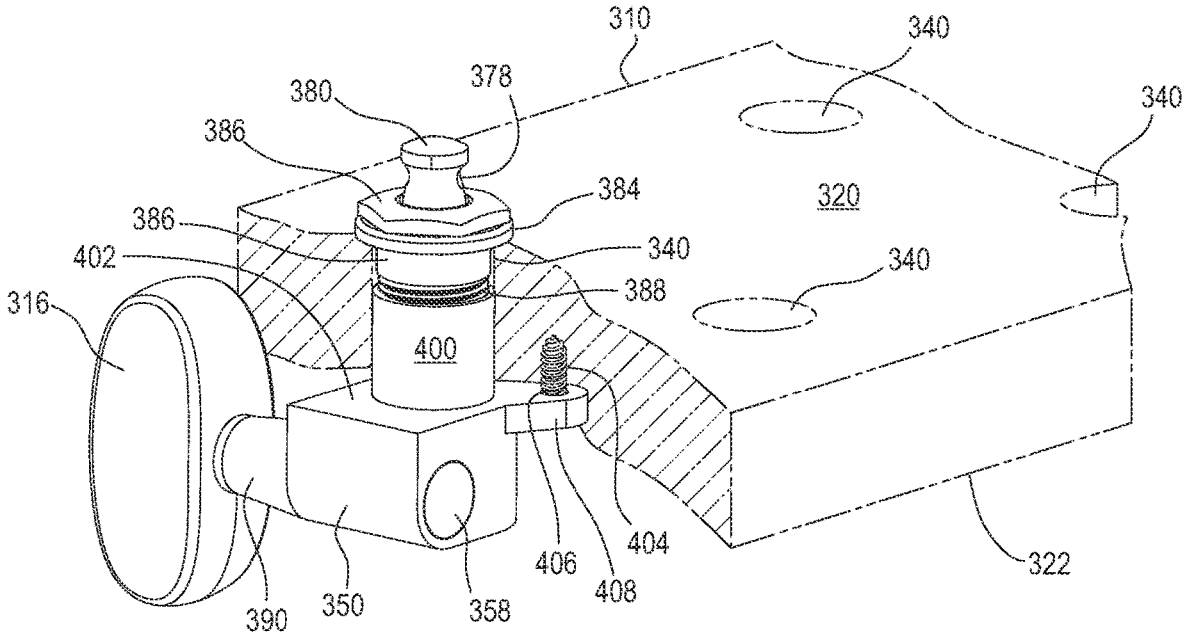
Figure 10C:
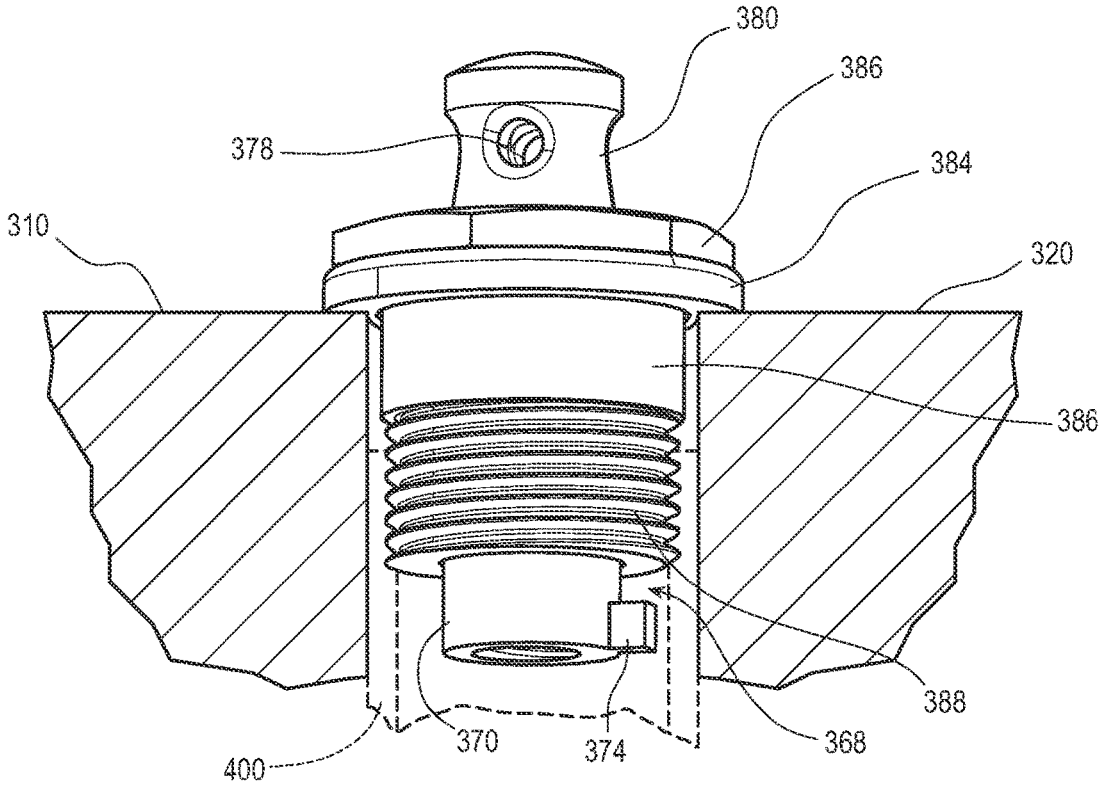

FIGS. 10*a*-10*c* show further detail of tuner 314. In FIG. 10*a*, shaft 400 of cast housing 350 is disposed within hole 340 of headstock 310. Flat surface 402 contacts surface 322 of headstock 310. Screw 404 is disposed with opening 406 of flange 408. Worm gear 358 with shaft 360 is disposed in opening 410 of cast housing 350. Inner string post 362 is inserted into outer string post 368, and the combination is disposed in opening 352 of cast housing 350, as shown in FIG. 10*b*. Opening 378 and upper cap 380 extend above surface 320 of headstock 310. Washer 384 is disposed around upper cap 380 and threads 388 of locking head 386 is screwed into the inner threads of opening 352. The outer string post 370 cannot become lost due to tab 374 contacting locking head 386, as shown in FIG. 10*c*. Locking head 386, being connected to cast housing 350, with threads, stops further unthreading between inner string post 362 and outer string post 368.

Figure 11:
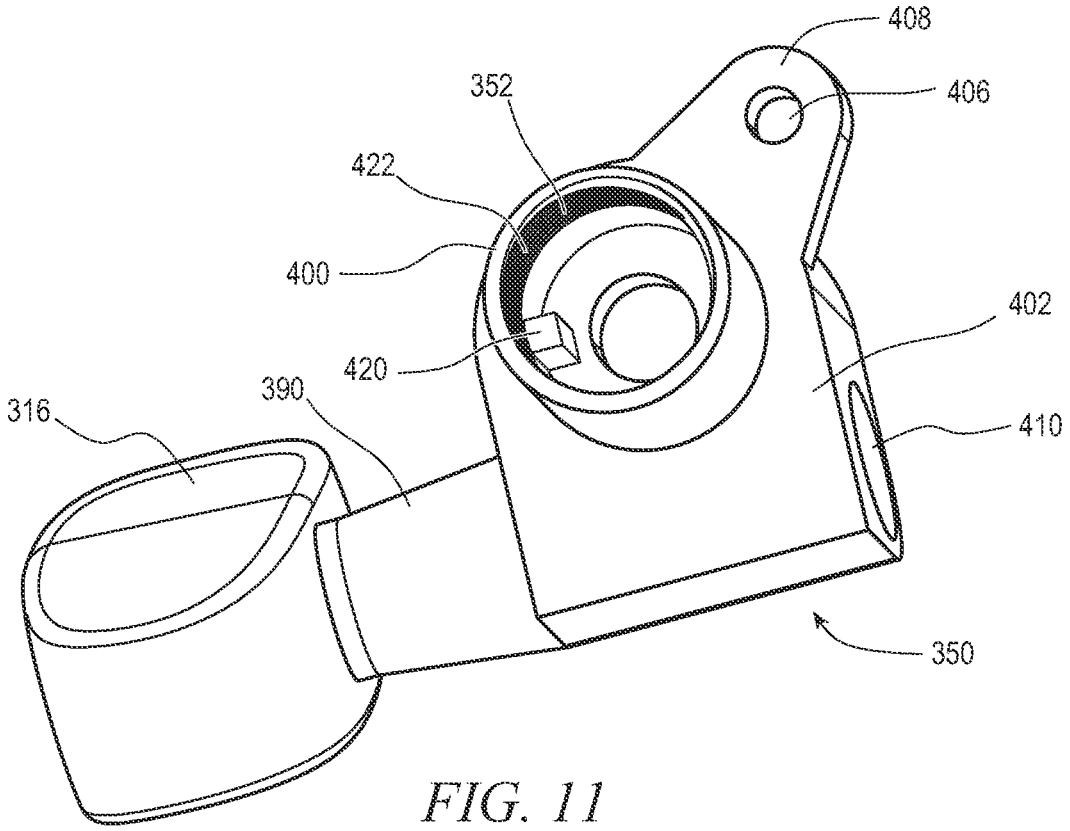
FIG. 11 illustrates the rotational stop tab within the cast housing.

FIG. 11 illustrates cast housing 350 prior to assembly with other components in tuner 314. In particular, cast housing 350 includes rotational stop tab 420 within opening 352 with threads 422. As will be explained, rotational stop tab 420 is intended to contact stop tab 374 of outer string post 368 during operation of self-locking tuner 314.

Figure 12:
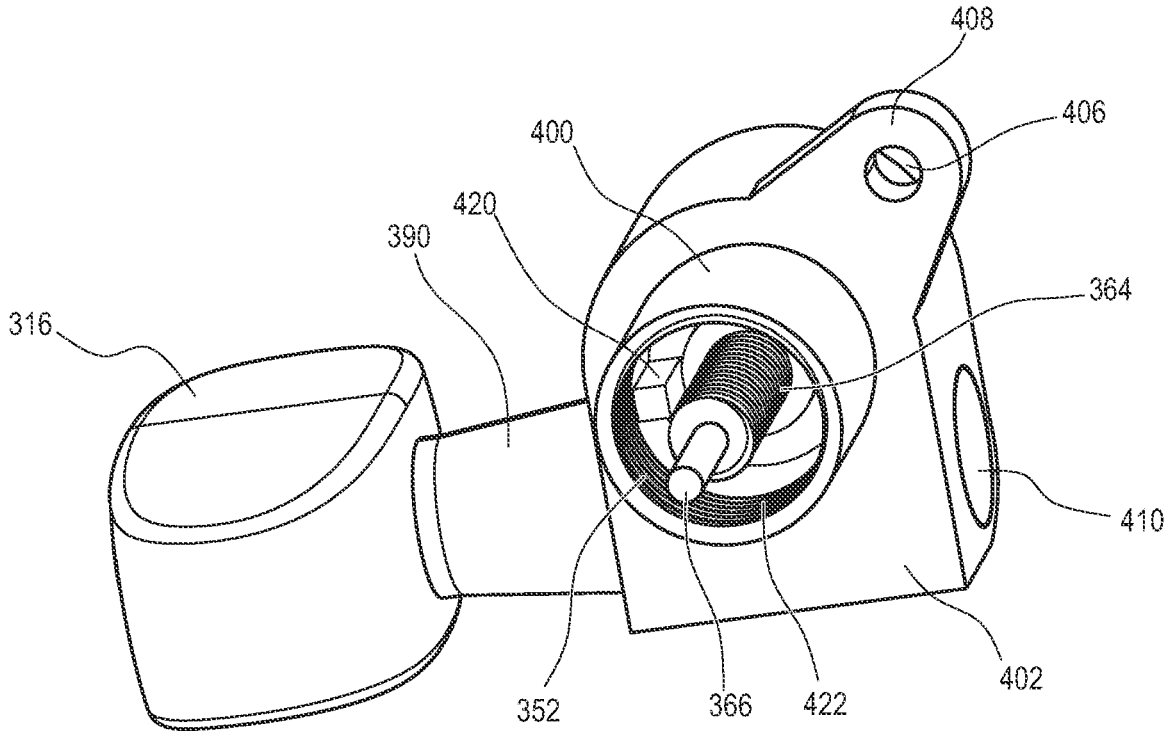
FIG. 12 illustrates the inner string post within the cast housing.

FIG. 12 illustrates inner string post 362 disposed within opening 352 of cast housing 350. Tuning knob 316 is connected to beveled surface 390.

Figure 13:
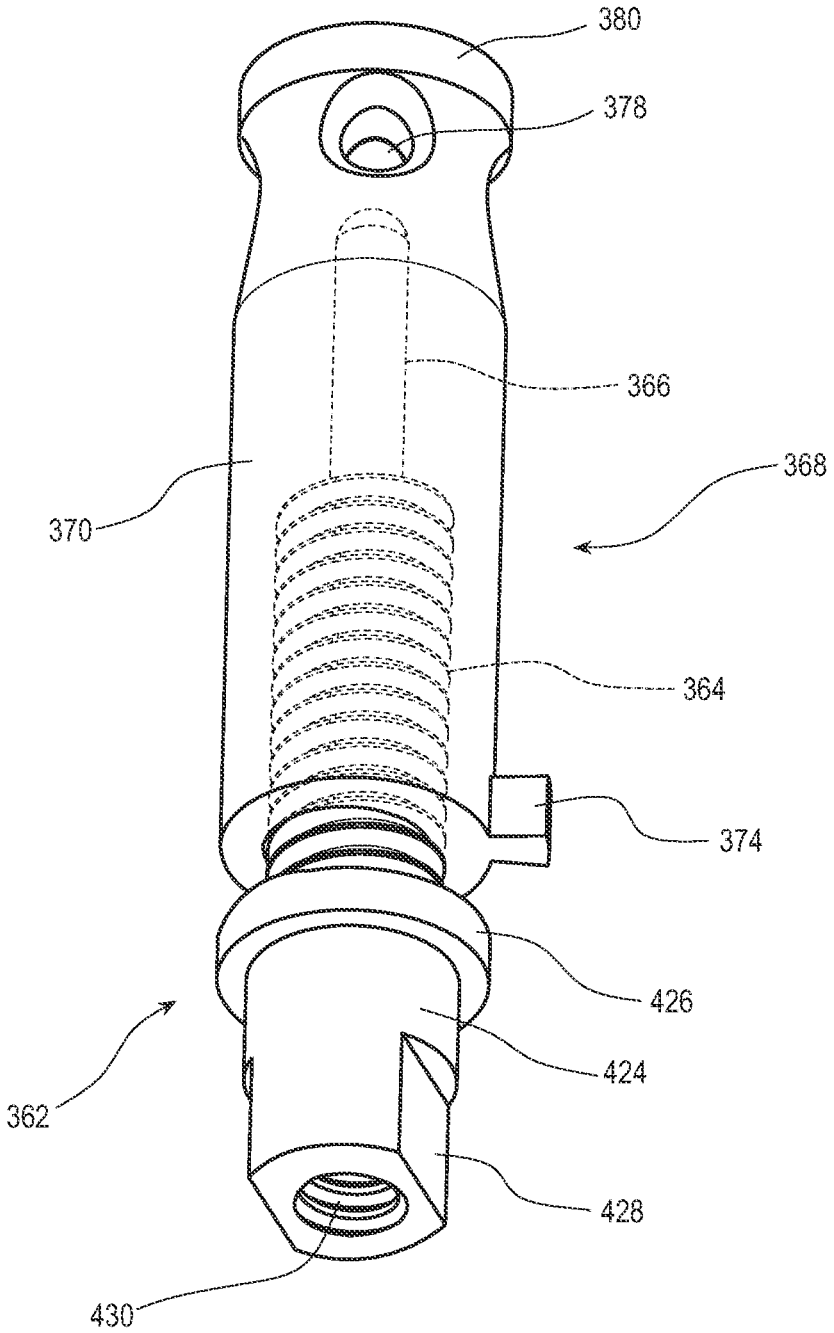
FIG. 13 illustrates the outer string post connected to the inner string post.

FIG. 13 illustrates outer string post 368 with stop tab 374 disposed over inner string post 362. Inner string post 362 includes base 424 with flange 426 and notched surface 428. Notched surface 428 passes through opening 352 of cast housing 350 and engages with a corresponding notched surface on gear 394 to cause inner string post 362 to turn with tuning knob 316, worm gear 358, and gear 394. Screw 398 from FIG. 9*b* is screwed into threaded opening 430.

Figure 14:
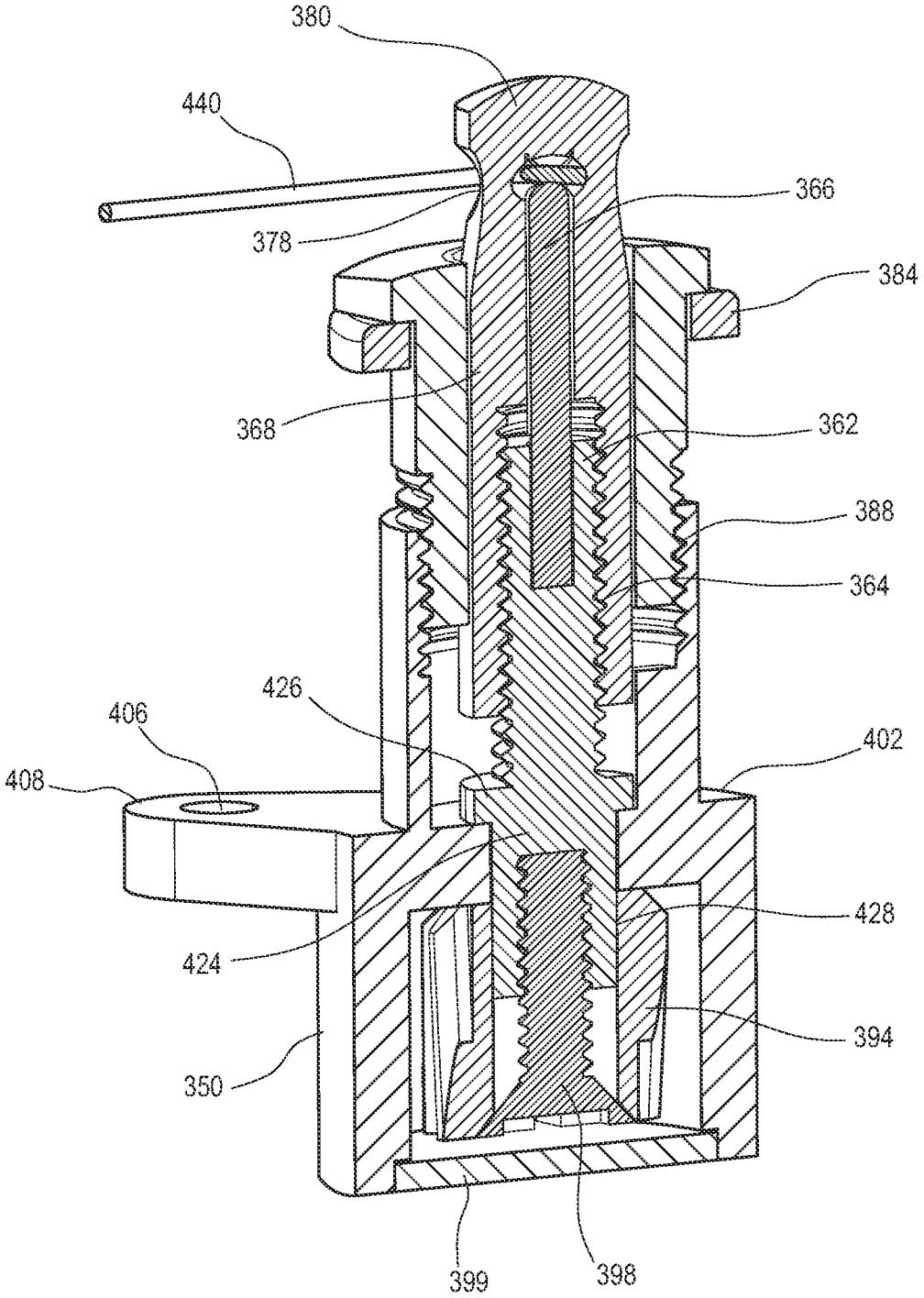
FIG. 14 illustrates a cross sectional view of the outer string post connected to the inner string post.

FIG. 14 illustrates a cross-sectional view of outer string post 368 disposed over inner string post 362. String 440 will be inserted through opening 378. Tuning knob 316 rotates inner string post 362, which screws into outer string post 368 until locking pin 366 pinches string 440 against the upper surface of opening 378. Outer string post 368 then rotates to apply tension to string 440. The string tension increases the grip between string 440 and the top surface of opening 378.

Figure 15A:
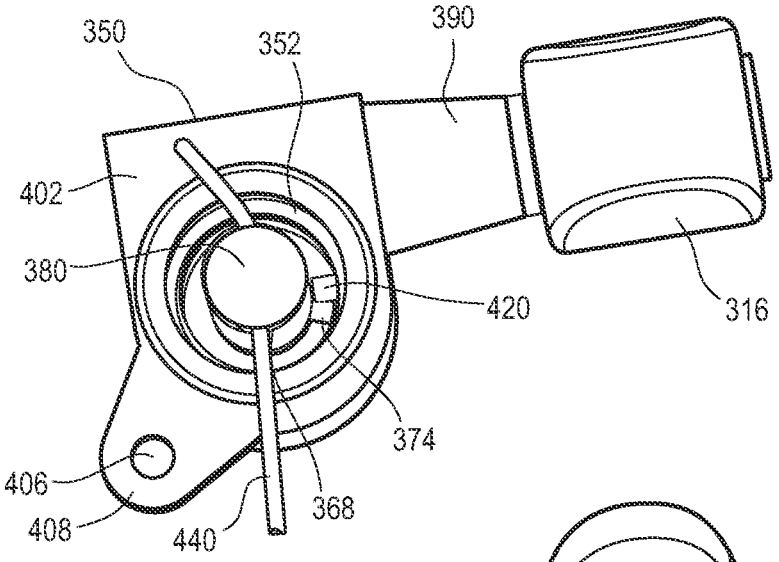
FIGS. 15*a*-15*c* illustrate the sealed self-locking tuners tuning the strings.
Figure 15B:
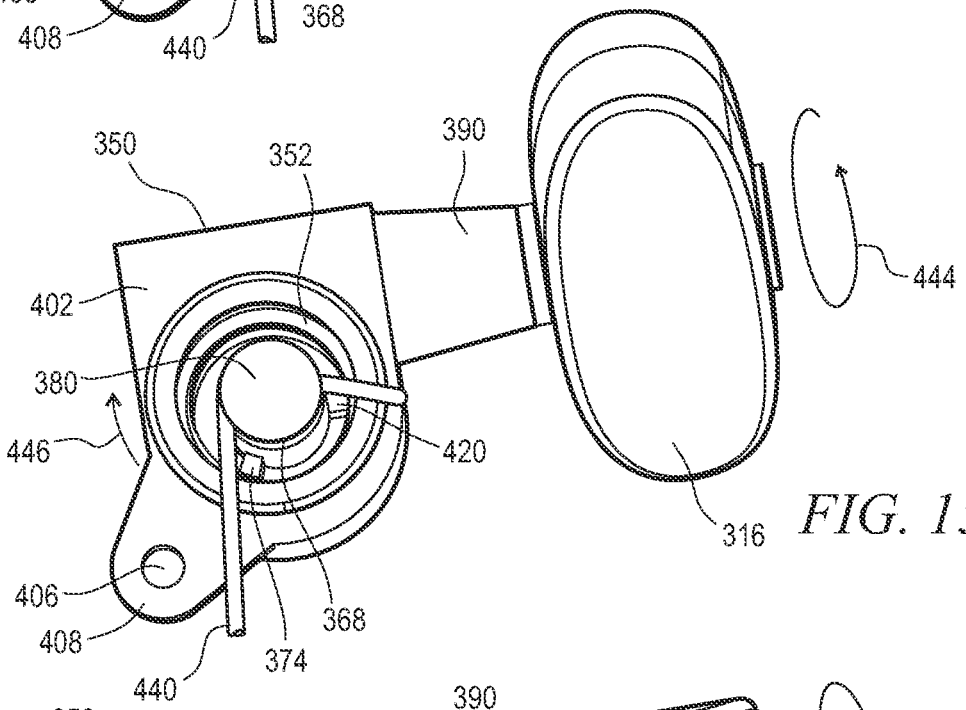

FIG. 15*a* shows further detail of one string 440 routed through one tuner 314. In FIG. 15*a*, string 440 is relaxed, not under tension. Tuning knob 316 uses a worm and gear mechanism within shaft 400 and cast housing 350 to rotate inner string post 362 and outer string post 368. Inner string post 362 is firmly affixed to the worm gear with screw 398. For right side tuners, turning tuning knob 316 counter-clockwise in the direction of arrow 444, turns outer string post 368 clockwise. For left side tuners, turning tuning knob 316 counter-clockwise, rotates outer string post 368 counter clockwise. Hence, the need for differently handed threads between inner sting posts and outer string posts, as shown in FIG. 5. However, outer string post 368 does not begin turning until threads 364 of inner string post 362 are sufficiently screwed into the mating threads of outer string post 368 so that locking pin 366 presses string 440 to lock the string against upper cap 380. When locking pin 366 locks string 440 against upper cap 380, outer string post 368 begins to rotate in the direction of arrow 446 to pull or stretch the string, as shown in FIG. 15*b*. Screw 404 keeps cast housing 350 from turning within headstock 310. String 440 resists the rotation of outer string post 368 and tightens the pressure between the outer string post, string, and locking pin 366. String 440 does not slip under locking pin 366 in tuner 314. Once locking pin 366 is set, continuing to turn tuning knob 316 rotates outer string post 368 in the direction of arrow 446 to pull or stretch string 440. The pulling or stretching of string 440 due to the turning of tuning knob 316 and resulting rotation of outer string post 368 tightens string 440 and alters its frequency of vibration, i.e., pitch of the string being tuned. Accordingly, tuning knob 316 can be turned in either direction to set the desired pitch of string 440. The clockwise rotation of outer string post 368 is limited to about 360° when outer string post rotational stop 374 contacts the opposite side of stop tab 420.

Figure 15C:
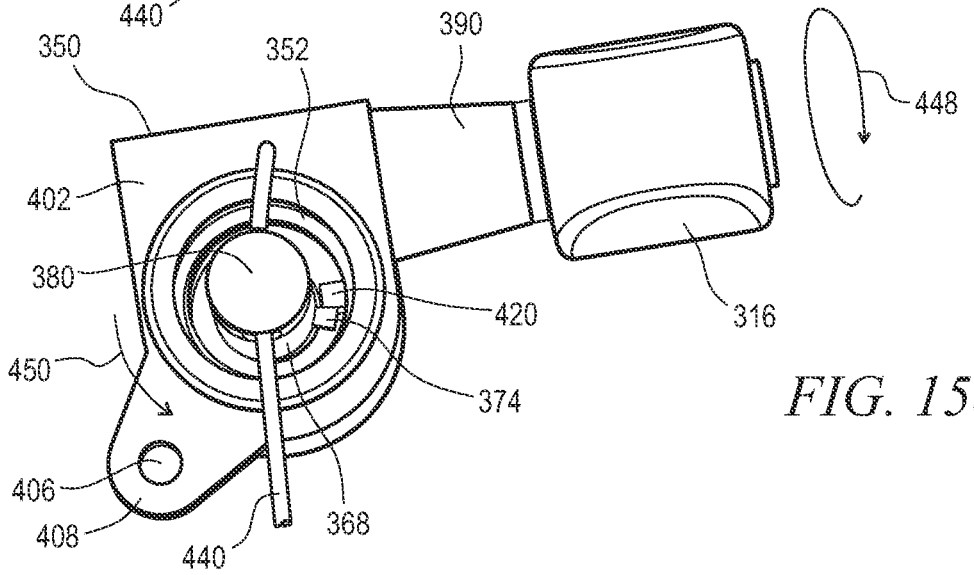

To remove string 440 from tuner 314, tuning knob 316 is turned in direction of arrow 448 to rotate outer string post 368 counter-clockwise in the direction of arrow 450 to rotate inner string post 362 with locking pin 366 until outer string post rotational stop 374 contacts rotational stop tab 420 inside cast housing 350, as shown in FIG. 15*c*. Cast housing 350 remains fixed in place by screw 404. As outer string post rotational stop 374 contacts rotational stop tab 420, any further turning of tuning knob 316 loosens threads 364 and draws down locking pin 366. String 440 can then be removed from opening 378.

While one or more embodiments of the present invention have been illustrated in detail, the skilled artisan will appreciate that modifications and adaptations to those embodiments may be made without departing from the scope of the present invention as set forth in the following claims.

What is claimed is:

1. A self-locking tuner for a stringed musical instrument, comprising:

an inner string post;

an outer string post disposed over the inner string post, wherein the outer string post includes an opening for accepting a string;

a locking pin extending above the inner string post and through the outer string post to the opening; and an insert disposed around the outer string post, wherein the insert includes a stop to unlock the string wherein the insert includes a tab to prevent rotation of the insert;

wherein the insert is disposed in a headstock of the stringed musical instrument with the tab disposed in a slot formed in a surface of the headstock.

2. The self-locking tuner of claim 1, wherein the outer string post includes a rotational stop which contacts the stop to unlock the string.

3. The self-locking tuner of claim 1, wherein the self-locking tuner is disposed in a headstock of the stringed musical instrument.

4. The self-locking tuner of claim 1, wherein the string extends through the opening in the outer string post.

5. A self-locking tuner for a stringed musical instrument, comprising:

an inner string post;

an outer string post disposed over the inner string post, wherein the outer string post includes a string opening; and a locking pin extending above the inner string post and through the outer string post to the string opening;

further included is an insert disposed around the outer string post, wherein the insert includes a stop to unlock a string;

wherein the insert includes a tab to prevent rotation of the insert; and further included is a cast housing disposed around the outer string post, wherein the cast housing includes a stop to unlock a string.

6. The self-locking tuner of claim 5, wherein the outer string post includes a rotational stop which contacts the stop to unlock the string.

7. The self-locking tuner of claim 5, wherein the insert is disposed in a headstock of the stringed musical instrument with the tab disposed in a slot formed in a surface of the headstock.

8. The self-locking tuner of claim 5, further including a string extending through the string opening in the outer string post.

9. A method of making a self-locking tuner for a stringed musical instrument, comprising:

providing an inner string post;

disposing an outer string post over the inner string post, wherein the outer string post includes a string opening; and providing a locking pin extending above the inner string post and through the outer string post to the string opening further including disposing an insert around the outer string post, wherein the insert includes a stop to unlock a string wherein the insert includes a tab to prevent rotation of the insert; and further including providing a cast housing disposed around the outer string post, wherein the cast housing includes a stop to unlock a string.

10. The method of claim 9, wherein the outer string post includes a rotational stop which contacts the stop to unlock the string.

11. The method of claim 9, wherein the insert is disposed in a headstock of the stringed musical instrument with the tab disposed in a slot formed in a surface of the headstock.

12. The method of claim 9, further including providing a string extending through the string opening in the outer string post.

13. A self-locking tuner for a stringed musical instrument, comprising:

an inner string post;

an outer string post disposed over the inner string post, wherein the outer string post includes a string opening; and a locking pin extending above the inner string post and through the outer string post to the string opening;

further included is a cast housing disposed around the outer string post, wherein the cast housing includes a stop to unlock a string.

14. A method of making a self-locking tuner for a stringed musical instrument, comprising:

providing an inner string post;

disposing an outer string post over the inner string post, wherein the outer string post includes a string opening; and providing a locking pin extending above the inner string post and through the outer string post to the string opening further including, providing a cast housing disposed around the outer string post, wherein the cast housing includes a stop to unlock a string.

* * * * *